US009972325B2

(12) United States Patent
Gao

(10) Patent No.: US 9,972,325 B2
(45) Date of Patent: May 15, 2018

(54) SYSTEM AND METHOD FOR MIXED CODEBOOK EXCITATION FOR SPEECH CODING

(71) Applicant: Huawei Technologies Co., Ltd., Shenzhen (CN)

(72) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 71 days.

(21) Appl. No.: 13/768,814

(22) Filed: Feb. 15, 2013

(65) Prior Publication Data

US 2013/0218578 A1 Aug. 22, 2013

Related U.S. Application Data

(60) Provisional application No. 61/599,938, filed on Feb. 17, 2012, provisional application No. 61/599,937, filed on Feb. 17, 2012.

(51) Int. Cl.
*G10L 19/00* (2013.01)
*G10L 19/12* (2013.01)

(52) U.S. Cl.
CPC ..... *G10L 19/00* (2013.01); *G10L 19/12* (2013.01)

(58) Field of Classification Search
CPC ..... G10L 19/14
See application file for complete search history.

(56) References Cited

U.S. PATENT DOCUMENTS

| | | | | |
|---|---|---|---|---|
| 5,602,961 | A * | 2/1997 | Kolesnik et al. | 704/223 |
| 5,699,485 | A | 12/1997 | Shoham | |
| 5,950,155 | A | 9/1999 | Nishiguchi | |
| 6,449,313 | B1 | 9/2002 | Erzin et al. | |
| 7,756,715 | B2 * | 7/2010 | Kim et al. | 704/501 |
| 7,797,156 | B2 * | 9/2010 | Preuss | G10L 15/20 704/226 |
| 2001/0027391 | A1 * | 10/2001 | Yasunaga | G10L 19/135 704/223 |

(Continued)

FOREIGN PATENT DOCUMENTS

| | | | |
|---|---|---|---|
| CN | 1271925 | A | 11/2000 |
| CN | 1539139 | A | 10/2004 |

(Continued)

OTHER PUBLICATIONS

De Lamare et al.; Strategies to improve the performance of very low bit rate speech coders and application to a variable rate 1.2 kb/s codec; Feb. 28, 2005; IEE Proceeding; vol. 152; pp. 74-85.*

(Continued)

*Primary Examiner* — Shreyans A Patel
(74) *Attorney, Agent, or Firm* — Slater Matsil, LLP

(57) ABSTRACT

In accordance with an embodiment, a method of encoding an audio/speech signal includes determining a mixed codebook vector based on an incoming audio/speech signal, where the mixed codebook vector includes a sum of a first codebook entry from a first codebook and a second codebook entry from a second codebook. The method further includes generating an encoded audio signal based on the determined mixed codebook vector, and transmitting a coded excitation index of the determined mixed codebook vector.

23 Claims, 11 Drawing Sheets

(56) References Cited

U.S. PATENT DOCUMENTS

| | | | | |
|---|---|---|---|---|
| 2002/0007269 | A1* | 1/2002 | Gao | 704/212 |
| 2002/0095284 | A1* | 7/2002 | Gao | G10L 21/0364 704/219 |
| 2003/0033136 | A1* | 2/2003 | Lee | G10L 19/12 704/2 |
| 2003/0046066 | A1* | 3/2003 | Kandhadai | G10L 19/10 704/216 |
| 2004/0049382 | A1* | 3/2004 | Yamaura | G10L 19/12 704/226 |
| 2004/0093207 | A1* | 5/2004 | Ashley | G10L 19/12 704/223 |
| 2004/0181411 | A1* | 9/2004 | Gao | G10L 19/005 704/262 |
| 2005/0075868 | A1* | 4/2005 | Rabha | 704/219 |
| 2006/0089833 | A1* | 4/2006 | Su | G10L 19/09 704/230 |
| 2006/0184362 | A1 | 8/2006 | Preuss et al. | |
| 2006/0253421 | A1 | 11/2006 | Fang et al. | |
| 2006/0271354 | A1* | 11/2006 | Sun | G10L 19/26 704/205 |
| 2006/0271356 | A1 | 11/2006 | Vos | |
| 2008/0071530 | A1* | 3/2008 | Ehara | G10L 19/005 704/223 |
| 2008/0154586 | A1* | 6/2008 | Gao | 704/223 |
| 2008/0294429 | A1* | 11/2008 | Su | G10L 19/09 704/222 |
| 2009/0240491 | A1 | 9/2009 | Reznik | |
| 2009/0281795 | A1* | 11/2009 | Ehara | G10L 19/24 704/205 |
| 2010/0241425 | A1* | 9/2010 | Eksler | G10L 19/08 704/220 |
| 2011/0051938 | A1 | 3/2011 | Han-Gil et al. | |
| 2011/0137661 | A1* | 6/2011 | Morii et al. | 704/500 |
| 2012/0087382 | A1 | 4/2012 | Gong et al. | |
| 2012/0185242 | A1 | 7/2012 | Morii | |

FOREIGN PATENT DOCUMENTS

| | | | |
|---|---|---|---|
| CN | 1711587 | A | 12/2005 |
| CN | 1989548 | A | 6/2007 |
| CN | 101557367 | | 10/2009 |
| CN | 101578508 | A | 11/2009 |
| CN | 102006144 | | 4/2011 |
| CN | 102129862 | A | 7/2011 |
| EP | 1496500 | A1 | 1/2005 |
| JP | 6053999 | A | 3/1985 |
| JP | H09190197 | A | 7/1997 |
| JP | 2005031683 | A | 2/2005 |
| JP | 2007226252 | A | 9/2007 |
| JP | 2008015356 | A | 1/2008 |
| KR | 1019970701410 | | 3/1997 |
| KR | 20080078924 | A | 8/2008 |
| RU | 2381572 | C2 | 2/2010 |
| RU | 2402826 | C2 | 10/2010 |
| RU | 2437172 | C1 | 12/2011 |
| WO | 2010003564 | A1 | 1/2010 |
| WO | 2012110473 | A1 | 8/2012 |

OTHER PUBLICATIONS de Lamare, "strategies to improve the performance of very low bit rate speech coders and application to a variable rate 1.2 kb/s code", Feb. 2005, IEE Proceedings—Vision, image and signal processing vol. 152 No. 1, p. 74-86.*

De Lamare et al., "Strategies to improve the performance of very low bit rate speech coders and application to a variable rate 1.2 kb/s codec," XP006023467, IEE Proceedings: Vision, Image and Signal Processing, Institution of Electrical Engineers, vol. 152, No. 1, Feb. 2005, pp. 74-86.

European Search Report, European Application No. 13874853.8, Applicant: Huawei Technologies Co., Ltd., dated Oct. 30, 2014, 6 pgs.

"Notification of Transmittal of the International Search Report and the Written Opinion of the International Searching Authority, or the Declaration," International Application Serial No. PCT/CN2013/080268; 11 pages, dated Nov. 21, 2013.

Kleijn, W.B., et al. "Fast Methods for the CELP Speech Coding Algorithm", IEEE Transactions on Acoustics, Speech and Signal Processing, Aug. 1990, pp. 1330-1342, vol. 38, No. 8.

* cited by examiner

SYSTEM AND METHOD FOR MIXED CODEBOOK EXCITATION FOR SPEECH CODING

This patent application claims priority to U.S. Provisional Application No. 61/599,937 filed on Feb. 17, 2012, entitled "Pulse-Noise Mixed Codebook Structure of Excitation for Speech Coding," and to U.S. Provisional Application No. 61/599,938 filed on Feb. 17, 2012, entitled "Fast Searching Approach of Mixed Codebook Excitation for Speech Coding," which applications are hereby incorporated by reference herein in their entirety.

TECHNICAL FIELD

The present invention is generally in the field of signal coding. In particular, the present invention is in the field of low bit rate speech coding.

BACKGROUND

Traditionally, all parametric speech coding methods make use of the redundancy inherent in the speech signal to reduce the amount of information that must be sent and to estimate the parameters of speech samples of a signal at short intervals. This redundancy primarily arises from the repetition of speech wave shapes at a quasi-periodic rate, and the slow changing spectral envelop of speech signal.

The redundancy of speech waveforms may be considered with respect to several different types of speech signal, such as voiced and unvoiced. For voiced speech, the speech signal is essentially periodic; however, this periodicity may be variable over the duration of a speech segment and the shape of the periodic wave usually changes gradually from segment to segment. A low bit rate speech coding could greatly benefit from exploring such periodicity. The voiced speech period is also called pitch, and pitch prediction is often named Long-Term Prediction (LTP). As for unvoiced speech, the signal is more like a random noise and has a smaller amount of predictability.

In either case, parametric coding may be used to reduce the redundancy of the speech segments by separating the excitation component of speech signal from the spectral envelope component. The slowly changing spectral envelope can be represented by Linear Prediction Coding (LPC), also known as Short-Term Prediction (STP). A low bit rate speech coding could also benefit from exploring such a Short-Term Prediction. The coding advantage arises from the slow rate at which the parameters change. Yet, it is rare for the parameters to be significantly different from the values held within a few milliseconds. Accordingly, at the sampling rate of 8 kHz, 12.8 kHz or 16 kHz, the speech coding algorithm is such that the nominal frame duration is in the range of ten to thirty milliseconds, where a frame duration of twenty milliseconds is most common. In more recent well-known standards such as G.723.1, G.729, G.718, EFR, SMV, AMR, VMR-WB or AMR-WB, the Code Excited Linear Prediction Technique ("CELP") has been adopted, which is commonly understood as a technical combination of Coded Excitation, Long-Term Prediction and Short-Term Prediction. Code-Excited Linear Prediction (CELP) Speech Coding is a very popular algorithm principle in speech compression area although the details of CELP for different CODECs differ significantly.

FIG. 1 illustrates a conventional CELP encoder where weighted error 109 between synthesized speech 102 and original speech 101 is minimized often by using a so-called analysis-by-synthesis approach. W(z) is an error weighting filter 110, 1/B(z) is a long-term linear prediction filter 105, and 1/A(z) is a short-term linear prediction filter 103. The coded excitation 108, which is also called fixed codebook excitation, is scaled by gain $G_c$ 106 before going through the linear filters. The short-term linear filter 103 is obtained by analyzing the original signal 101 and represented by a set of coefficients:

$$A(z) = \sum_{i=1}^{P} 1 + a_i \cdot z^{-i},\ i = 1, 2, \ldots, P. \tag{1}$$

The weighting filter 110 is somehow related to the above short-term prediction filter. A typical form of the weighting filter is:

$$W(z) = \frac{A(z/\alpha)}{A(z/\beta)}, \tag{2}$$

where $\beta<\alpha$, $0<\beta<1$, $0<\alpha\leq 1$. In the standard codec ITU-T G.718, the perceptual weighting filter has the following form:

$$W(z) = A(z/\gamma_1)H_{de-emph}(z) = A(z/\gamma_1)/(1-\beta_1 z^{-1}), \tag{3}$$

where, $$H_{de-emph}(z) = \frac{1}{1-\beta_1 z^{-1}} \tag{4}$$

and $\beta_1$ is equal to 0.68.

The long-term prediction 105 depends on pitch and pitch gain. A pitch may be estimated, for example, from the original signal, residual signal, or weighted original signal. The long-term prediction function in principal may be expressed as $$B(z)=1-\beta\cdot z^{-Pitch}. \tag{5}$$

The coded excitation 108 normally comprises a pulse-like signal or noise-like signal, which are mathematically constructed or saved in a codebook. Finally, the coded excitation index, quantized gain index, quantized long-term prediction parameter index, and quantized short-term prediction parameter index are transmitted to the decoder.

FIG. 2 illustrates an initial decoder that adds a post-processing block 207 after synthesized speech 206. The decoder is a combination of several blocks that are coded excitation 201, excitation gain 202, long-term prediction 203, short-term prediction 205 and post-processing 207. Every block except post-processing block 207 has the same definition as described in the encoder of FIG. 1. Post-processing block 207 may also include short-term post-processing and long-term post-processing.

FIG. 3 shows a basic CELP encoder that realizes the long-term linear prediction by using adaptive codebook 307 containing a past synthesized excitation 304 or repeating past excitation pitch cycle at pitch period. Pitch lag may be encoded in integer value when it is large or long and pitch lag may be encoded in more precise fractional value when it is small or short. The periodic information of pitch is employed to generate the adaptive component of the excitation. This excitation component is then scaled by gain $G_p$ 305 (also called pitch gain). The second excitation component is generated by coded-excitation block 308, which is scaled by gain $G_c$ 306. Gc is also referred to as fixed codebook gain, since the coded-excitation often comes from a fixed codebook. The two scaled excitation components are added together before going through the short-term linear prediction filter 303. The two gains ($G_p$ and $G_c$) are quantized and then sent to a decoder.

FIG. 4 illustrates a conventional decoder corresponding to the encoder in FIG. 3, which adds a post-processing block 408 after a synthesized speech 407. This decoder is similar to FIG. 2 with the addition of adaptive codebook 307. The decoder is a combination of several blocks, which are coded excitation 402, adaptive codebook 401, short-term prediction 406, and post-processing 408. Every block except post-processing block 408 has the same definition as described in the encoder of FIG. 3. Post-processing block 408 may further include of short-term post-processing and long-term post-processing.

Long-Term Prediction plays very important role for voiced speech coding because voiced speech has a strong periodicity. The adjacent pitch cycles of voiced speech are similar each other, which means mathematically that pitch gain $G_p$ in the following excitation expression is high or close to 1, $$e(n)=G_p \cdot e_p(n)+G_c \cdot e_c(n), \tag{6}$$

where $e_p(n)$ is one subframe of sample series indexed by n, coming from the adaptive codebook 307 which comprises the past excitation 304; $e_p(n)$ may be adaptively low-pass filtered as low frequency area is often more periodic or more harmonic than high frequency area; $e_c(n)$ is from the coded excitation codebook 308 (also called fixed codebook) which is a current excitation contribution; and $e_c(n)$ may also be enhanced using high pass filtering enhancement, pitch enhancement, dispersion enhancement, formant enhancement, and the like. For voiced speech, the contribution of $e_p(n)$ from the adaptive codebook may be dominant and the pitch gain $G_p$ 305 may be a value of about 1. The excitation is usually updated for each subframe. A typical frame size is 20 milliseconds and typical subframe size is 5 milliseconds.

SUMMARY OF THE INVENTION

In accordance with an embodiment, a method of encoding an audio/speech signal includes determining a mixed codebook vector based on an incoming audio/speech signal, the mixed codebook vector comprising a sum of a first codebook entry from a first codebook and a second codebook entry from a second codebook. The method further includes generating an encoded audio signal based on the determined mixed codebook vector, and transmitting a coded excitation index of the determined mixed codebook vector.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in different figures generally refer to corresponding parts unless otherwise indicated. The figures are drawn to clearly illustrate the relevant aspects of the preferred embodiments and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to embodiments in a specific context, namely a CELP-based audio encoder and decoder. It should be understood that embodiments of the present invention may be directed toward other systems such as.

As already mentioned, CELP is mainly used to encode speech signal by benefiting from specific human voice characteristics or human vocal voice production model. CELP algorithm is a very popular technology that has been used in various ITU-T, MPEG, 3GPP, and 3GPP2 standards. In order to encode speech signal more efficiently, a speech signal may be classified into different classes and each class is encoded in a different way. For example, in some standards such as G.718, VMR-WB or AMR-WB, a speech signal is classified into UNVOICED, TRANSITION, GENERIC, VOICED, and NOISE. For each class, a LPC or STP filter is always used to represent spectral envelope; but the excitation to the LPC filter may be different. UNVOICED and NOISE may be coded with a noise excitation and some excitation enhancement. TRANSITION may be coded with a pulse excitation and some excitation enhancement without using adaptive codebook or LTP. GENERIC may be coded with a traditional CELP approach such as Algebraic CELP used in G.729 or AMR-WB, in which one 20 ms frame contains four 5 ms subframes, both the adaptive codebook excitation component and the fixed codebook excitation component are produced with some excitation enhancements for each subframe, pitch lags for the adaptive codebook in the first and third subframes are coded in a full range from a minimum pitch limit PIT_MIN to a maximum pitch limit PIT_MAX, and pitch lags for the adaptive codebook in the second and fourth subframes are coded differentially from the previous coded pitch lag. A VOICED class signal may be coded slightly differently from GNERIC, in which pitch lag in the first subframe is coded in a full range from a minimum pitch limit PIT_MIN to a maximum pitch limit PIT_MAX, and pitch lags in the other subframes are coded differentially from the previous coded pitch lag.

Figure 1:
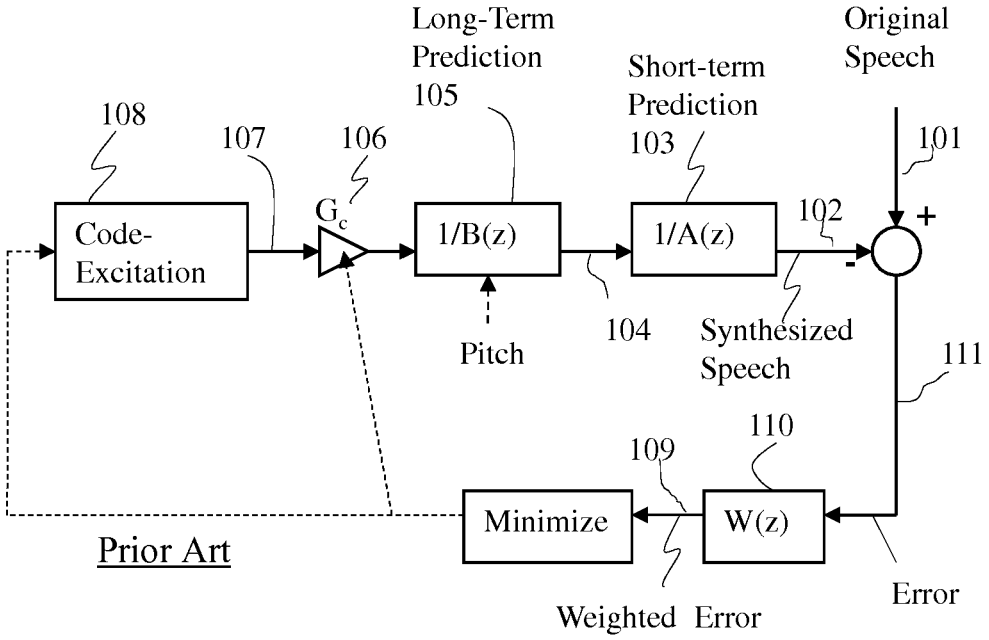
FIG. 1 illustrates a conventional CELP speech encoder.
Figure 2:
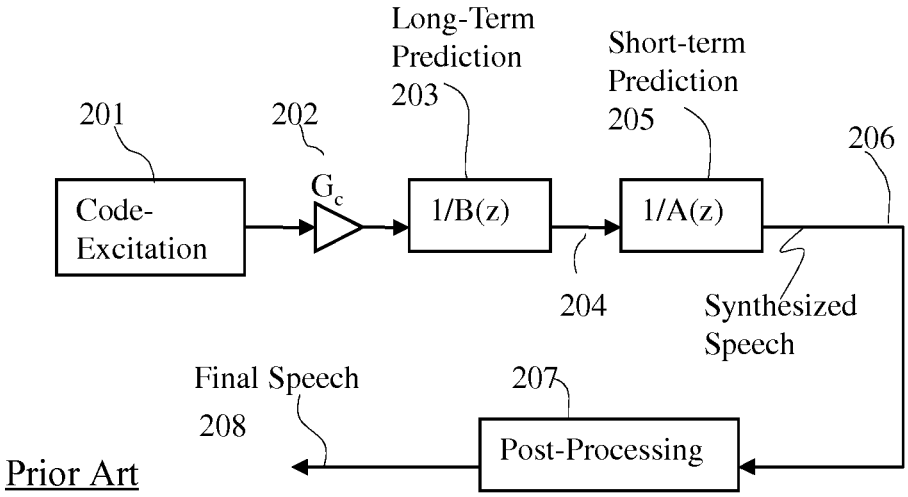
FIG. 2 illustrates a conventional CELP speech decoder.
Figure 3:
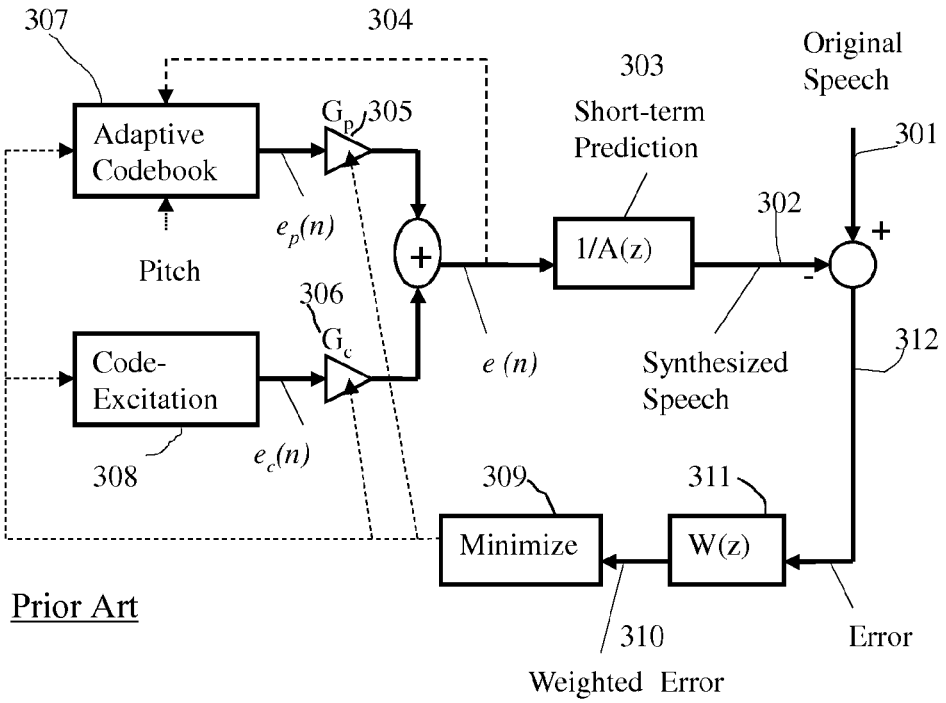
FIG. 3 illustrates a conventional CELP encoder that utilizes an adaptive codebook.
Figure 4:
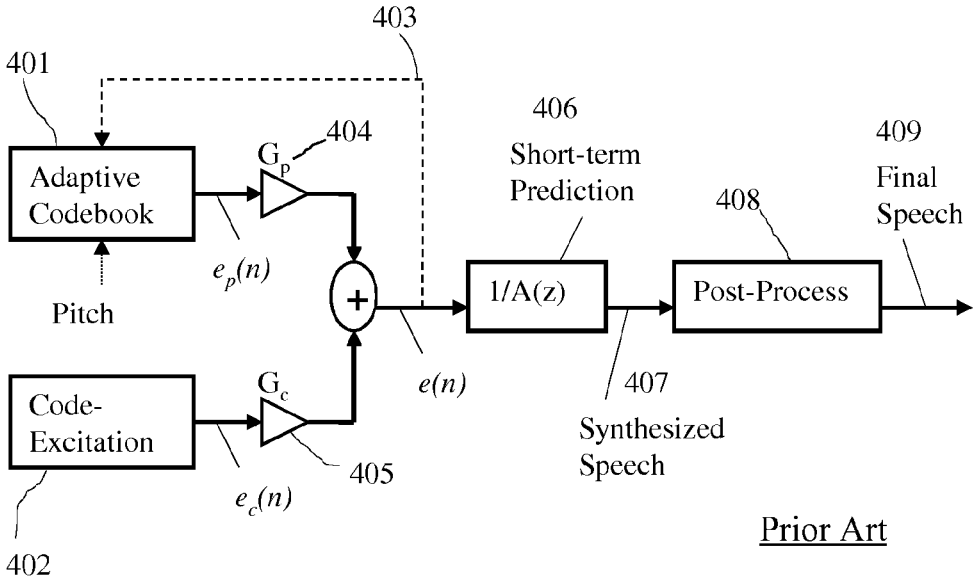
FIG. 4 illustrates a conventional CELP speech decoder that utilizes an adaptive codebook.
Figure 5:
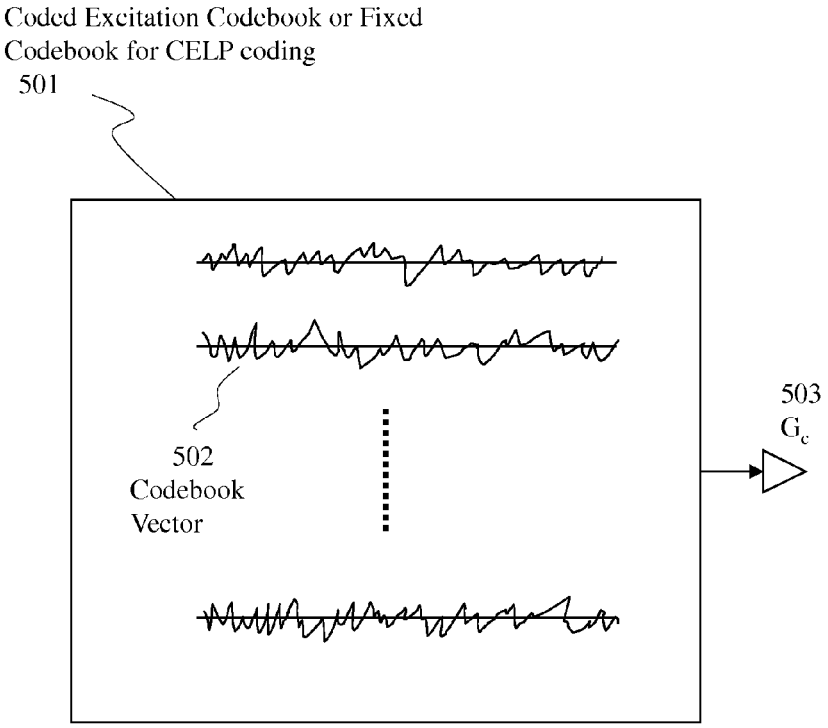
FIG. 5 illustrates a FCB structure that contains noise-like candidate vectors for constructing a coded excitation.
Figure 6:
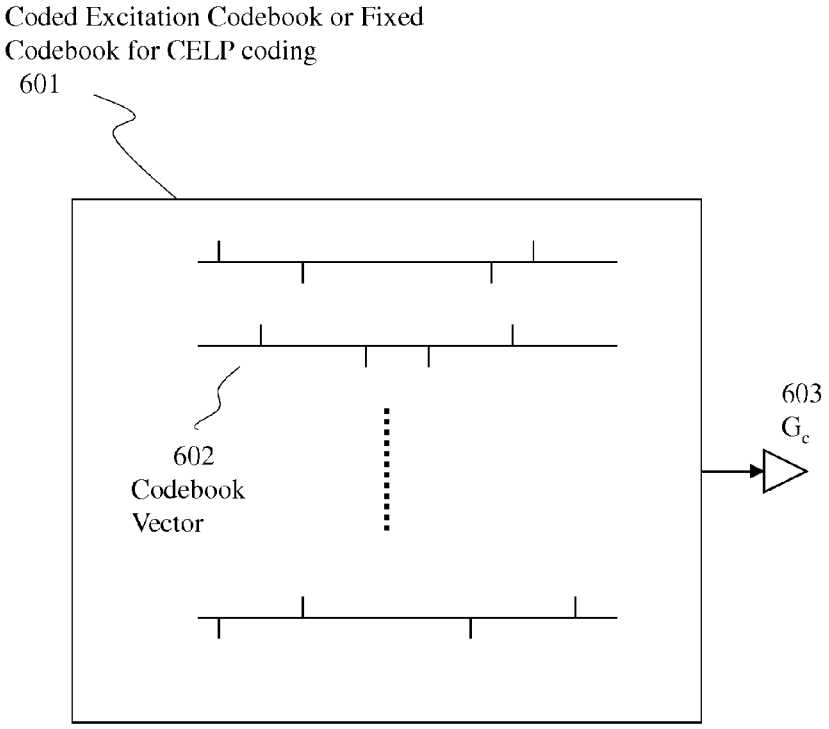
FIG. 6 illustrates a FCB structure that contains pulse-like candidate vectors for constructing a coded excitation.

Code-Excitation block 402 in FIG. 4 and 308 in FIG. 3 show the location of Fixed Codebook (FCB) for a general CELP coding; a selected code vector from FCB is scaled by a gain often noted as $G_c$. For NOISE or UNVOICED class signal, an FCB containing noise-like vectors may be the best structure from perceptual quality point of view, because the adaptive codebook contribution or LTP contribution would be small or non-existent, and because the main excitation contribution relies on the FCB component for NOISE or UNVOICED class signal. In this case, if a pulse-like FCB such as that shown in FIG. 6 is used, the output synthesized speech signal could sound spiky due to the many zeros found in the code vector selected from a pulse-like FCB designed for low bit rate coding. FIG. 5 illustrates a FCB structure that contains noise-like candidate vectors for constructing a coded excitation. 501 is a noise-like FCB; 502 is a noise-like code vector; and a selected code vector is scaled by a gain 503.

For a VOICED class signal, a pulse-like FCB yields a higher quality output than a noise-like FCB from perceptual point of view, because the adaptive codebook contribution or LTP contribution is dominant for the highly periodic VOICED class signal and the main excitation contribution does not rely on the FCB component for the VOICED class signal. In this case, if a noise-like FCB is used, the output synthesized speech signal may sound noisy or less periodic, since it is more difficult to have good waveform matching by using the code vector selected from the noise-like FCB designed for low bit rate coding. FIG. 6 illustrates a FCB structure that contains pulse-like candidate vectors for constructing a coded excitation. 601 represents a pulse-like FCB, and 602 represents a pulse-like code vector. A selected code vector is scaled by a gain 603.

Most CELP codecs work well for normal speech signals; however low bit rate CELP codecs could fail in the presence of an especially noisy speech signal or for a GENERIC class signal. As already described, a noise-like FCB may be the best choice for NOISE or UNVOICED class signal and a pulse-like FCB may be the best choice for VOICED class signal. The GENERIC class is between VOICED class and UNVOICED class. Statistically, LTP gain or pitch gain for GENERIC class may be lower than VOICED class but higher than UNVOICED class. The GENERIC class may contain both a noise-like component signal and periodic component signal. At low bit rates, if a pulse-like FCB is used for GENERIC class signal, the output synthesized speech signal may still sound spiky since there are a lot of zeros in the code vector selected from the pulse-like FCB designed for low bit rate coding. For example, when an 6800 bps or 7600 bps codec encodes a speech signal sampled at 12.8 kHz, a code vector from the pulse-like codebook may only afford to have two non-zero pulses, thereby causing a spiky sound for noisy speech. If a noise-like FCB is used for GENERIC class signal, the output synthesized speech signal may not have a good enough waveform matching to generate a periodic component, thereby causing noisy sound for clean speech. Therefore, a new FCB structure between noise-like and pulse-like may be needed for GENERIC class coding at low bit rates.

Figure 7:
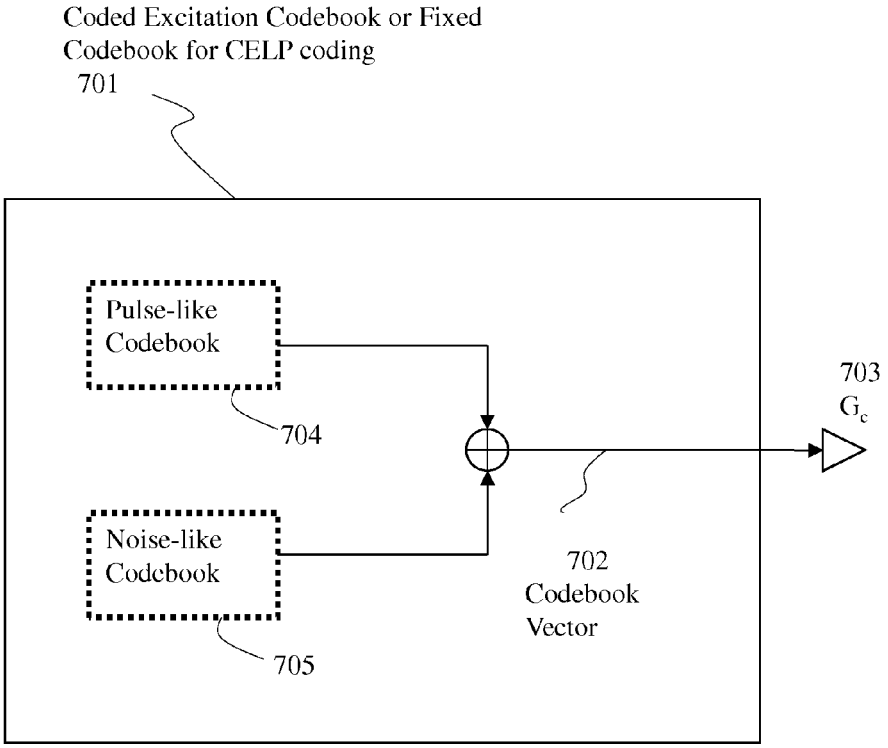
FIG. 7 illustrates an embodiment structure of the pulse-noise mixed FCB.

One of the solutions for having better low-bit rates speech coding for GENERIC class signal is to use a pulse-noise mixed FCB instead of a pulse-like FCB or a noise-like FCB. FIG. 7 illustrates an embodiment structure of the pulse-noise mixed FCB. 701 indicates the whole pulse-noise mixed FCB. The selected code vector 702 is generated by combining (adding) a vector from a pulse-like sub-codebook 704 and a vector from a noise-like sub-codebook 705. The selected code vector 702 is then scaled by the FCB gain $G_c$ 703. For example, 6 bits are assigned to the pulse-like sub-codebook 704, in which 5 bits are to code one pulse position and 1 bit is to code a sign of the pulse-like vectors; 6 bits are assigned to the noise-like sub-codebook 705, in which 5 bits are to code 32 different noise-like vectors and 1 bit is to code a sign of the noise-like vectors.

Figure 8:
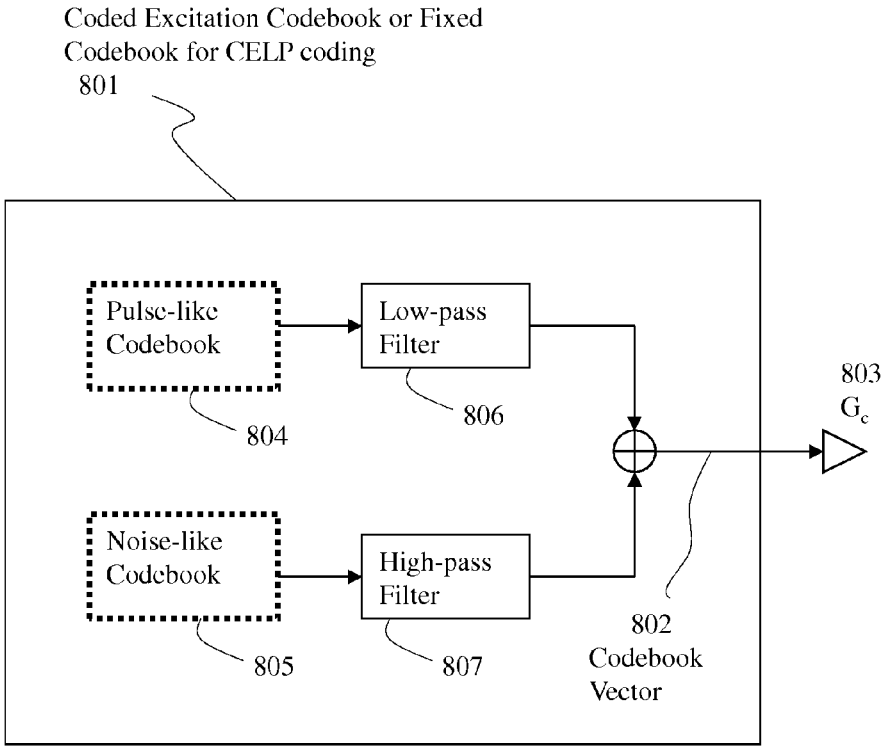
FIG. 8 illustrates an embodiment structure of a pulse-noise mixed FCB.

FIG. 8 illustrates an embodiment structure of a pulse-noise mixed FCB 801. As a code vector from a pulse-noise mixed FCB is a combination of a vector from a pulse-like sub-codebook and a vector from a noise-like sub-codebook, different enhancements may be applied respectively to the vector from the pulse-like sub-codebook and the vector from the noise-like sub-codebook. For example, a low pass filter can be applied to the vector from the pulse-like sub-codebook; this is because low frequency area is often more periodic than high frequency area and low frequency area needs more pulse-like excitation than high frequency area; a high pass filter can be applied to the vector from the noise-like sub-codebook; this is because high frequency area is often more noisy than low frequency area and high frequency area needs more noise-like excitation than low frequency area. Selected code vector 802 is generated by combining (adding) a low-pass filtered vector from a pulse-like sub-codebook 804 and a high-pass filtered vector from a noise-like sub-codebook 805. 806 indicates the low-pass filter that may be fixed or adaptive. For example, a first-order filter $(1+0.4\ Z^{-1})$ is used for a GENERIC speech frame close to voiced speech signal and one-order filter $(1+0.3\ Z^{-1})$ is used for a GENERIC speech frame close to unvoiced speech signal. 807 indicates the high-pass filter which can be fixed or adaptive; for example, one-order filter $(1-0.4\ Z^{-1})$ is used for a GENERIC speech frame close to unvoiced speech signal and one-order filter $(1-0.3\ Z^{-1})$ is used for a GENERIC speech frame close to voiced speech signal. Enhancement filters 806 and 807 normally do not spend bits to code the filter coefficients, and the coefficients of the enhancement filters may be adaptive to available parameters in both encoder and decoder. The selected code vector 802 is then scaled by the FCB gain $G_c$ 803. As the example given for FIG. 8, if 12 bits are available to code the pulse-noise mixed FCB, in FIG. 8, 6 bits can be assigned to the pulse-like sub-codebook 804, in which 5 bits are to code one pulse position and 1 bit is to code a sign of the pulse-like vectors. For example, 6 bits can be assigned to the noise-like sub-codebook 805, in which 5 bits are to code 32 different noise-like vectors and 1 bit is to code a sign of the noise-like vectors.

Figure 9:
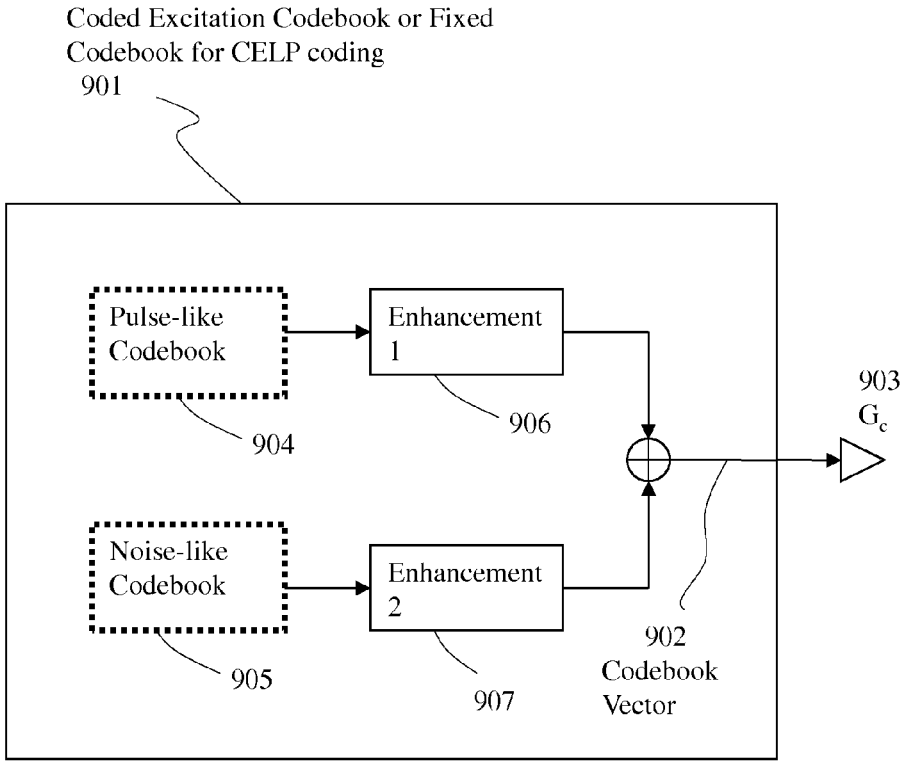
FIG. 9 illustrates a general structure of an embodiment pulse-noise mixed FCB.

FIG. 9 illustrates a more general structure of an embodiment pulse-noise mixed FCB 901. As a code vector from the pulse-noise mixed FCB in FIG. 9 is a combination of a vector from a pulse-like sub-codebook and a vector from a noise-like sub-codebook, different enhancements may be applied respectively to the vector from the pulse-like subcodebook and the vector from the noise-like sub-codebook. For example, an enhancement including low pass filter, high-pass filter, pitch filter, and/or formant filter can be applied to the vector from the pulse-like sub-codebook; similarly, an enhancement including low pass filter, high-pass filter, pitch filter, and/or formant filter can be applied to the vector from the noise-like sub-codebook. Selected code vector 902 is generated by combining (adding) an enhanced vector from a pulse-like sub-codebook 904 and an enhanced vector from a noise-like sub-codebook 905. 906 indicates the enhancement for the pulse-like vectors, which can be fixed or adaptive. 907 indicates the enhancement for the noise-like vectors, which can also be fixed or adaptive. The enhancements 906 and 907 normally do not spend bit to code the enhancement parameters. The parameters of the enhancements can be adaptive to available parameters in both encoder and decoder. The selected code vector 902 is then scaled by the FCB gain $G_c$ 903. As the example given for FIG. 9, if 12 bits are available to code the pulse-noise mixed FCB in FIG. 9, 6 bits can be assigned to the pulse-like sub-codebook 904, in which 5 bits are to code one pulse position and 1 bit is to code a sign of the pulse-like vectors; and 6 bits can be assigned to the noise-like sub-codebook 905, in which 5 bits are to code 32 different noise-like vectors and 1 bit is to code a sign of the noise-like vectors.

Figure 10:
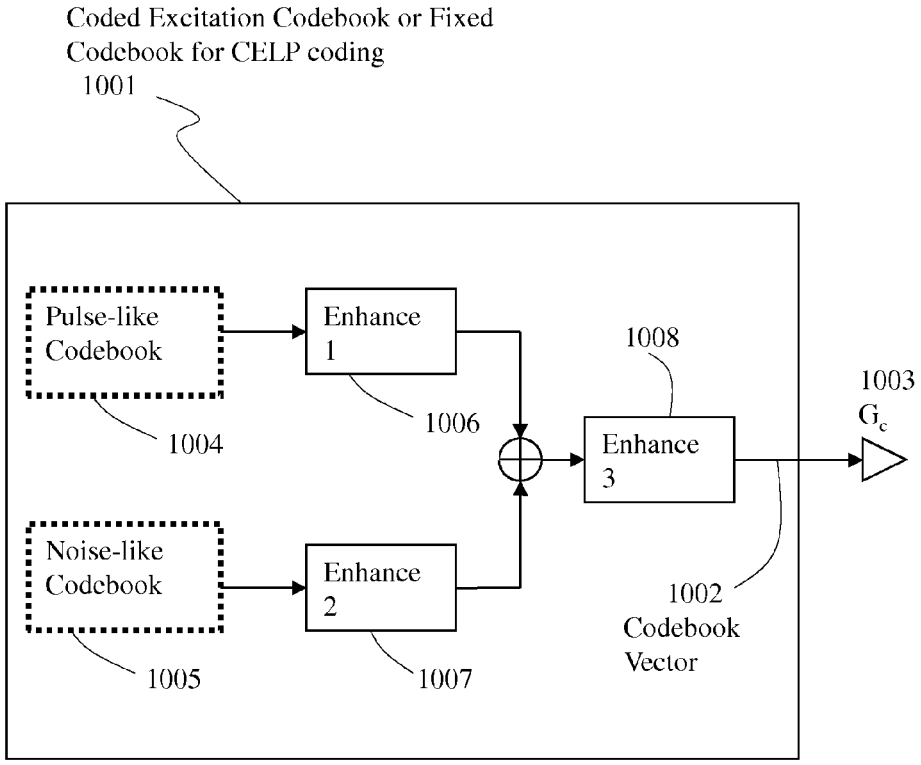
FIG. 10 illustrates a further general structure of an embodiment pulse-noise mixed FCB.

FIG. 10 illustrates a further general structure of an embodiment pulse-noise mixed FCB. As a code vector from the pulse-noise mixed FCB in FIG. 10 is a combination of a vector from a pulse-like sub-codebook and a vector from a noise-like sub-codebook, different enhancements can be applied respectively to the vector from the pulse-like sub-codebook and the vector from the noise-like sub-codebook. For example, a first enhancement including low pass filter, high-pass filter, pitch filter, and/or formant filter can be applied to the vector from the pulse-like sub-codebook; similarly, a second enhancement including low pass filter, high-pass filter, pitch filter, and/or formant filter can be applied to the vector from the noise-like sub-codebook. 1001 indicates the whole pulse-noise mixed FCB. The selected code vector 1002 is generated by combining (adding) a first enhanced vector from a pulse-like sub-codebook 1004 and a second enhanced vector from a noise-like sub-codebook 1005. 1006 indicates the first enhancement for the pulse-like vectors, which can be fixed or adaptive. 1007 indicates the second enhancement for the noise-like vectors, which can also be fixed or adaptive. 1008 indicates the third enhancement for the pulse-noise combined vectors, which can also be fixed or adaptive. The enhancements 1006, 1007, and 1008 normally do not spend bits to code the enhancement parameters; as the parameters of the enhancements can be adaptive to available parameters in both encoder and decoder. The selected code vector 1002 is then scaled by the FCB gain $G_c$ 1003. As the example given for FIG. 10, if 12 bits are available to code the pulse-noise mixed FCB in FIG. 10, 6 bits can be assigned to the pulse-like sub-codebook 1004, in which 5 bits are to code one pulse position and 1 bit is to code a sign of the pulse-like vectors; 6 bits can be assigned to the noise-like sub-codebook 1005, in which 5 bits are to code 32 different noise-like vectors and 1 bit is to code a sign of the noise-like vectors. If the FCB gain $G_c$ is signed, only one of the sign for the pulse-like vectors and the sign for the noise-like vectors needs to be coded.

Figure 11:
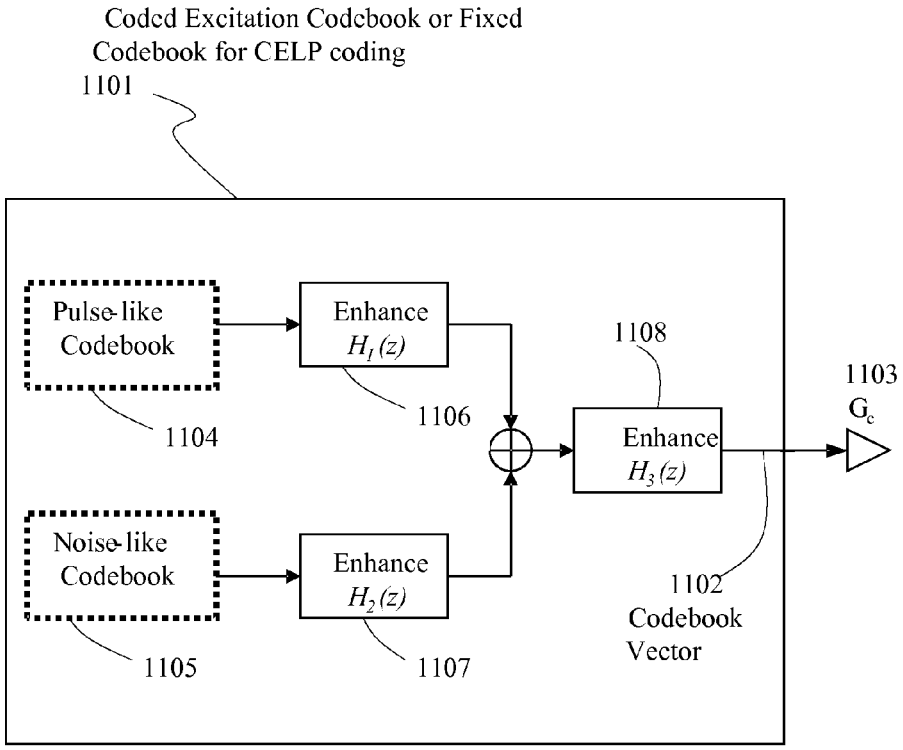
FIG. 11 illustrates a further general structure of an embodiment pulse-noise mixed FCB.

FIG. 11 illustrates a further general structure of an embodiment pulse-noise mixed FCB. As a code vector from the pulse-noise mixed FCB in FIG. 11 is a combination of a vector from a pulse-like sub-codebook and a vector from a noise-like sub-codebook, different enhancements can be applied respectively to the vector from the pulse-like sub-codebook and the vector from the noise-like sub-codebook. For example, a first enhancement $H_1(z)$ including low pass filter, high-pass filter, pitch filter, and/or formant filter can be applied to the vector from the pulse-like sub-codebook; similarly, a second enhancement $H_2(z)$ including low pass filter, high-pass filter, pitch filter, and/or formant filter can be applied to the vector from the noise-like sub-codebook. 1101 indicates the whole pulse-noise mixed FCB. The selected code vector 1102 is generated by combining (adding) a first enhanced vector from a pulse-like sub-codebook 1104 and a second enhanced vector from a noise-like sub-codebook 1105. 1106 indicates the first enhancement $H_1(z)$ for the pulse-like vectors, which can be fixed or adaptive. 1107 indicates the second enhancement $H_2(z)$ for the noise-like vectors, which can also be fixed or adaptive. 1108 indicates the third enhancement $H_3(z)$ for the pulse-noise combined vectors, which can also be fixed or adaptive. Normally no bits are spent to code the enhancement parameters of the enhancements 1106, 1107, and 1108; as the parameters of the enhancements can be adaptive to available parameters in both encoder and decoder. Selected code vector 1102 is then scaled by the FCB gain $G_c$ 1103. As the example given for FIG. 11, if 12 bits are available to code the pulse-noise mixed FCB in FIG. 11, 6 bits can be assigned to the pulse-like sub-codebook 1104, in which 5 bits are to code one pulse position and 1 bit is to code a sign of the pulse-like vectors; 6 bits can be assigned to the noise-like sub-codebook 1105, in which 5 bits are to code 32 different noise-like vectors and 1 bit is to code a sign of the noise-like vectors. If the FCB gain $G_c$ 1103 is signed, only one of the sign for the pulse-like vectors and the sign for the noise-like vectors needs to be coded.

Figure 12:
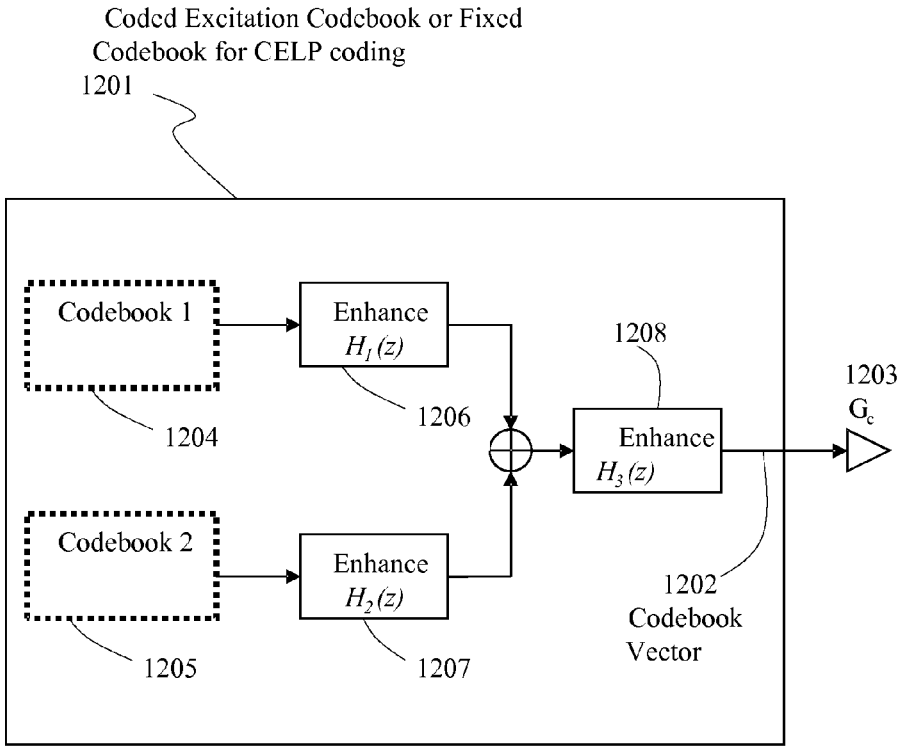
FIG. 12 illustrates a more general structure of an embodiment mixed FCB.

FIG. 12 shows a more general structure of an embodiment mixed FCB. The main difference between FIG. 12 and FIG. 11 is that Codebook 1 in block 1204 may contain pulse-like or noise-like vectors and Codebook 2 in the block 1205 may also contain pulse-like or noise-like vectors; this means the mixed codebook can be any combination of pulse-like and/or noise-like vectors. As a code vector from the mixed FCB in FIG. 12 is a combination of a vector from Codebook 1 and a vector from Codebook 2, different enhancements may be applied respectively to the vector from the Codebook 1 and the vector from the Codebook 2. For example, an enhancement $H_1(z)$ including low pass filter, high-pass filter, pitch filter, and/or formant filter can be applied to the vector from the Codebook 1. Similarly, an enhancement $H_2(z)$ including low pass filter, high-pass filter, pitch filter, and/or formant filter can be applied to the vector from the Codebook 2. 1201 indicates the whole mixed FCB. The selected code vector 1202 is generated by combining (adding) an enhanced vector from Codebook 1 and an enhanced vector from Codebook 2. 1206 indicates the enhancement $H_1(z)$ for the vectors of Codebook 1, which can be fixed or adaptive. 1207 indicates the enhancement $H_2(z)$ for the vectors of Codebook 2, which may also be fixed or adaptive. 1208 indicates the third enhancement $H_3(z)$ for the combined vectors, which can also be fixed or adaptive. The enhancements 1206, 1207, and 1208 normally do not spend bits to code the enhancement parameters; as the parameters of the enhancements can be adaptive to available parameters in both encoder and decoder. The selected code vector 1202 is then scaled by the FCB gain $G_c$ 1203.

Suppose the fixed codebook structure is as shown in FIG. 11, and the excitation signal is coded per subframes of 64 samples, i.e., four times per frame; this section provides a fast searching approach for a pulse-noise mixed codebook. The principle of excitation coding is shown in a schematic diagram in FIG. 13, which is actually similar to the principle shown in FIG. 3. Theoretically, FIG. 3 allows a joint optimization of the adaptive codebook excitation component and the fixed codebook excitation component (i.e. code-excitation component). In practice, for reasons of simplicity, the adaptive codebook excitation component is often determined first and then the fixed codebook excitation component.

For each subframe, the LP residual is given by $$r(n) = s(n) + \sum_{i=0}^{P} a_i \cdot s(n-i),\ n = 0, 1, \ldots 63 \tag{7}$$

where s(n) is an input signal 1301 that is often pre-emphasized and used for wideband speech coding but not for narrow band speech coding. For example, the pre-emphasis filter can be $$H_{emph}(z)=1-\beta_1 z^{-1} \tag{8}$$

and $\beta_1$ is equal to 0.68. Alternatively, $\beta_1$ may take on different values.

Target signal 1303 x(n) for the adaptive codebook 1307 search is may be computed by subtracting a zero-input response (not shown in FIG. 13) of the weighted synthesis filter W(z)/A(z) from the weighted pre-emphasized input signal which is obtained by filtering the input signal 1301 s(n) through the weighting filter 1302. This is performed on a subframe basis. An equivalent procedure for computing the target signal is filtering of the residual signal r(n) through the combination of the synthesis filter 1/A(z) and the weighting filter W(z).

Impulse response h(n) of the weighted synthesis filter W(z)/A(z) is computed for each subframe. In the equation above, A(z) is the quantized LP filter. The impulse response h(n) is needed for the search of adaptive and fixed codebooks. The adaptive codebook search includes performing a closed-loop pitch search, and then computing the adaptive code vector, $e_p(n)$, by interpolating the past excitation at a selected fractional pitch lag P. $e_p(n)$ can be enhanced, for example, by applying an adaptive low-pass filter. The adaptive codebook parameters (or pitch parameters) are the closed-loop pitch P and the pitch gain 1305, $g_p$ (adaptive codebook gain), calculated for each subframe. y(n) notes the filtered adaptive codebook contribution before the pitch gain 1305 is applied. Details about calculating the adaptive codebook parameters will not be discussed here as this section focuses on describing the mixed FCB (fixed codebook) search.

After the filtered and gained adaptive codebook contribution is subtracted from the target signal x(n), the obtained difference signal $x_2(n)$ 1304 becomes the second target signal for determining the code-excitation contribution. The code-excitation $e_c(n)$ 1308 and the corresponding gain $G_c$ 1306 are determined through the minimization 1309 of the weighted error 1310.

Figure 13:
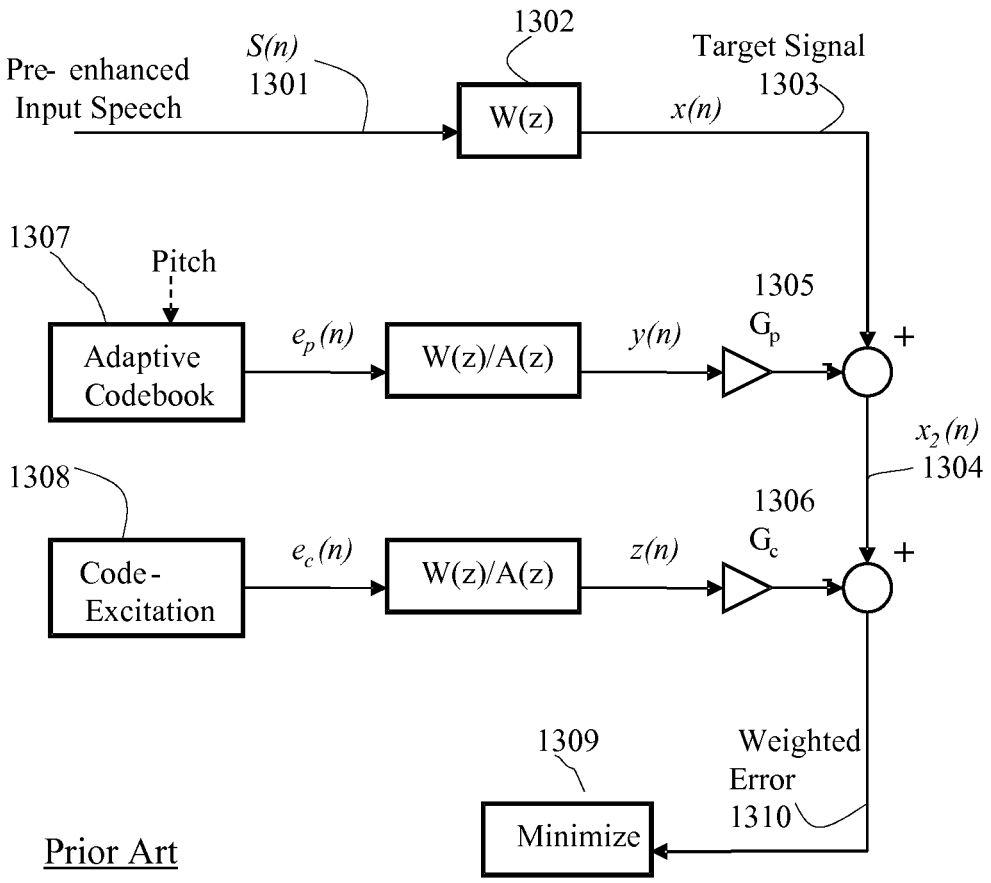
FIG. 13 illustrates a block diagram of an excitation coding system.
Figure 14:
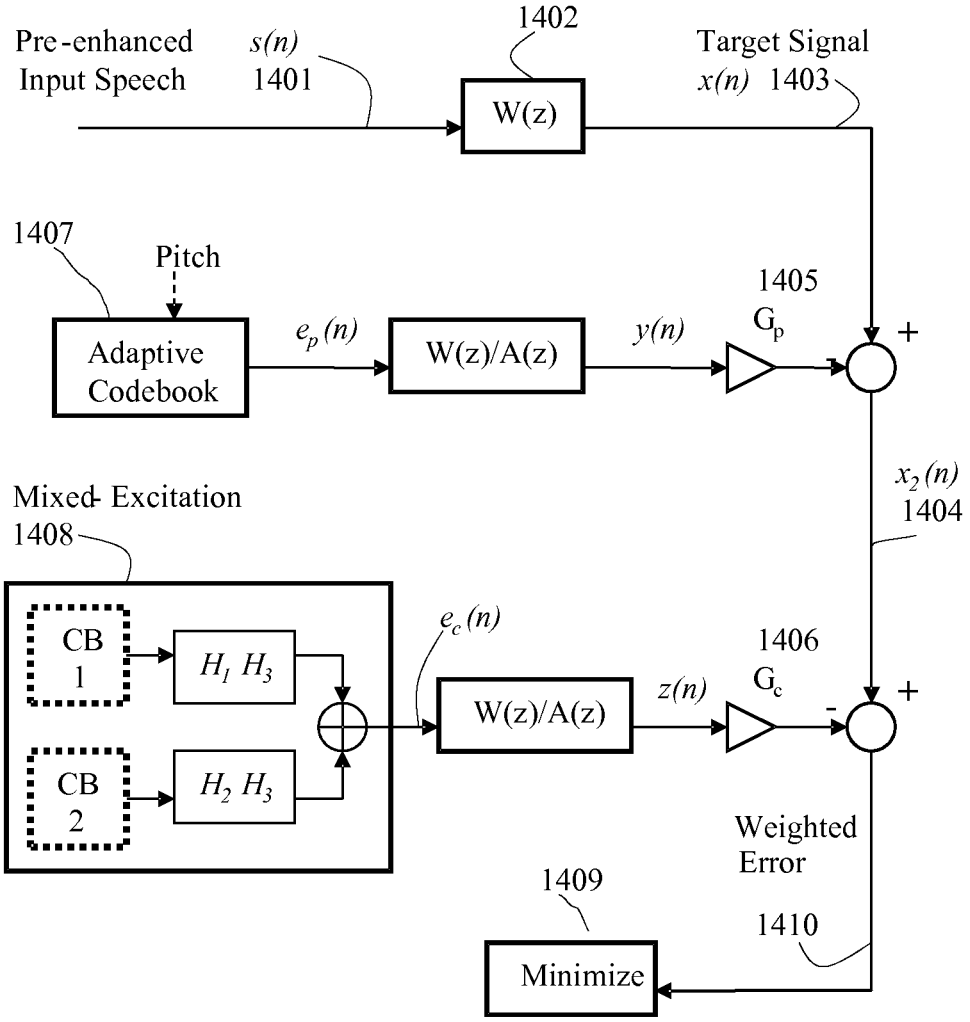
FIG. 14 illustrates a block diagram of an embodiment mixed codebook-based excitation coding system.

FIG. 14 shows a similar structure as FIG. 13, except the fixed codebook or code-excitation in FIG. 14 is now specifically a mixed codebook structure. The target signal 1403 x(n) for the adaptive codebook 1407 search is computed by subtracting a zero-input response (not shown in FIG. 14) of the weighted synthesis filter W(z)/A(z) from the weighted pre-emphasized input signal; and the weighted pre-emphasized input signal is obtained by filtering the input signal s(n) 1401 through the weighting filter 1402. The adaptive codebook parameters (or pitch parameters) are the closed-loop pitch and the pitch gain 1405, $g_p$ (adaptive codebook gain), calculated for each subframe. y(n) notes the filtered adaptive codebook contribution before the pitch gain 1405 is applied. After the filtered and gained adaptive codebook contribution is subtracted from the target signal 1403 x(n), the obtained difference signal $x_2(n)$ 1404 becomes the second target signal for determining the mixed codebook excitation contribution. The mixed codebook excitation 1408 $e_c(n)$ and the corresponding gain 1406 $G_c$ are determined through the minimization 1409 of the weighted error 1410. z(n) notes the filtered mixed codebook contribution before the gain 1406 $G_c$ is applied.

Suppose CB 1 in the mixed codebook 1408 is a pulse-like codebook and CB 2 in the mixed codebook 1408 is a noise-like codebook. $H_1(z)$ in 1408 notes the enhancement filter for CB 1 vectors, $H_2(z)$ in 1408 notes the enhancement filter for CB 2 vectors, and $H_3(z)$ in 1408 notes the enhancement filter for both CB 1 and CB 2 vectors. For the convenience of the following description, the impulsive response of $H_1(z)$, $H_2(z)$, or $H_3(z)$ is noted as $h_1(n)$, $h_2(n)$, or $h_3(n)$ respectively.

The pulse-like codebook CB 1 index, or code word, represents the pulse positions and signs. Thus, no codebook storage is needed since the code vector can be constructed in the decoder through the information contained in the index itself (no look-up tables). The different pulse-like codebooks can be constructed by placing a certain number of signed pulses in a certain number of tracks. The independent or temporal search of the pulse-like codebook can be performed by first combining the enhancement filters $H_1(z)$ and $H_3(z)$ with the weighted synthesis filter W(z)/A(z) prior to the codebook search. Thus, the impulse response h(n) of the weighted synthesis filter must be modified to include the enhancement filters $H_1(z)$ and $H_3(z)$. That is, $$h_p(n)=h_1(n)*h_3(n)*h(n). \tag{9}$$

The noise-like codebook CB 2 index, or code word, represents the noise vectors and signs. The noise-like codebook is normally saved in a memory storage. In order to reduce the memory size, the noise vectors may be overlapped and generated by shifting a noise vector position. The independent or temporal search of the noise-like codebook may be performed by first combining the enhancement filters $H_2(z)$ and $H_3(z)$ with the weighted synthesis filter W(z)/A(z) prior to the codebook search. Thus, the impulse response h(n) of the weighted synthesis filter must be modified to include the enhancement filters $H_2(z)$ and $H_3(z)$. That is, $$h_n(n)=h_2(n)*h_3(n)*h(n). \tag{10}$$

As $H_3(z)$ is commonly used for both pulse-like vectors and noise-like vectors, the impulse response of the combination of the synthesis filter 1/A(z), the weighting filter W(z) and the enhancement filter $H_3(z)$ is specifically noted as, $$hh(n)=h_3(n)*h(n). \tag{11}$$

The mixed codebook is searched by minimizing the error between an updated target signal 1404 $x_2(n)$ and a scaled filtered code vector. The updated target signal is given by $$x_2(n)=x(n)-G_p \cdot y(n), n=0,1, \ldots ,63 \tag{12}$$

where $y(n)=e_p(n)*h(n)$ is the filtered adaptive code vector and $G_p$ is the adaptive codebook gain. Let a matrix H be defined as a lower triangular Toeplitz convolution matrix with the main diagonal hh(0) and lower diagonals hh(1), . . . , hh(63), and $d=H^T x_2$ (also known as the backward filtered target vector) be the correlation between the updated signal $x_2(n)$ and the impulse response hh(n). Furthermore, let $\Phi=H^T H$ be the matrix of correlations of hh(n). Theoretically, the elements of the vector d(n) may be computed by $$d(n)=\sum_{i=n}^{63} x_2(i)\cdot hh(i-n),\ n=0,1,\ldots 63, \tag{13}$$

and the elements of the symmetric matrix Φ can be computed by $$\varphi(i,j)=\sum_{n=j}^{63} hh(n-i)\cdot hh(n-j),\ i=0,1,\ldots 63;\ j=i,\ldots 63. \tag{14}$$

In some embodiments, equation (13) may be calculated by using a simpler backward filtering, and equation (14) may not be needed in the current case for fast search of the mixed pulse-noise codebook.

Let $c_k(n)$ be a mixed code vector that is $$c_k(n)=c_p(n)*h_1(n)+c_n(n)*h_2(n), n=0,1,\ldots 63. \tag{15}$$

Here, $c_p(n)$ is a candidate vector from the pulse-like codebook and $c_n(n)$ is a candidate vector from the noise-like codebook. The mixed codebook excitation $c_k(n)$ or $e_c(n)=c_k(n)*h_3(n)$ and the corresponding gain 1103 $G_c$ of the mixed codebook excitation may be determined through the minimization 1109 of weighted error 1110:

$$Err=\sum_{n=0}^{63} |x_2(n)-G_c\cdot z(n)|^2. \tag{16}$$

The minimization of (16) is equivalent to the maximization of the following criterion:

$$Q_k=\frac{(x_2^T z_k)^2}{z_k^T z_k}=\frac{(x_2^T H c_k)^2}{c_k^T H^T H c_k}=\frac{(d^T c_k)^2}{c_k^T \Phi c_k}=\frac{(R_k)^2}{E_k}. \tag{17}$$

In (17), $z_k$ is the filtered contribution of the mixed excitation codebook:

$$z_k=Hc_k. \tag{18}$$

In some embodiments, vector d(n) and matrix Φ are computed prior to the codebook search. In some embodiments, the calculation of matrix Φ may not be needed and, therefore, omitted.

The correlation in the numerator of equation (17) is given by $$\begin{aligned} R_k &= d^T c_k \\ &= d^T(H_1 c_p + H_2 c_n) \\ &= d^T H_1 c_p + d^T H_2 c_n \\ &= (H_1^T d)^T c_p + (H_2^T d)^T c_n \\ &= d_1^T c_p + d_2^T c_n. \end{aligned} \tag{19}$$

In (19), $d_1=H_1^T d$ and $d_2=H_2^T d$ may be pre-calculated by simply backward-filtering d(n) through the filter $H_1(z)$ and $H_2(z)$. If $H_1(z)$ and $H_2(z)$ are implemented using first-order filters, the backward-filtering processes are simple. The energy in the denominator of equation (17) is given by $$\begin{aligned} E_k &= c_k^T \Phi c_k \\ &= (H_1 c_p + H_2 c_n)^T H^T H (H_1 c_p + H_2 c_n) \\ &= (HH_1 c_p)^T (HH_1 c_p) + 2(HH_1 c_p)^T (HH_2 c_n) + (HH_2 c_n)^T (HH_2 c_n) \\ &= (H_p c_p)^T (H_p c_p) + 2(H_p c_p)^T (H_n c_n) + (H_n c_n)^T (H_n c_n) \\ &= z_p^T z_p + 2 z_p^T z_n + z_n^T z_n. \end{aligned} \tag{20}$$

In (20), $H_p=HH_1$ and $H_n=HH_2$ may be pre-calculated by the following filtering processes or convolutions:

$$h_p(n)=h_1(n)*hh(n) \leftrightarrow H_p(z)=H_1(z)H_3(z)W(z)/A(z) \tag{21}$$

$$h_n(n)=h_2(n)*hh(n) \leftrightarrow H_n(z)=H_2(z)H_3(z)W(z)/A(z). \tag{22}$$

In some embodiments, $H_1(z)$ and $H_2(z)$ may be implemented using first-order filters; so, the filtering processing in (21) or (22) is as simple as hh(n) is already calculated in (11).

In (20), $z_p$ is the filtered pulse contribution:

$$z_p=H_p c_p \tag{23}$$

and $z_n$ is the filtered noise contribution:

$$z_n=H_n c_n. \tag{24}$$

Equation (20) may be further expressed as, $$\begin{aligned} E_k &= z_p^T z_p + 2 z_p^T z_n + z_n^T z_n \\ &= E_p + 2 z_p^T z_n + E_n \end{aligned} \tag{25}$$

where $$E_p = z_p^T z_p \tag{26}$$

is the energy of the filtered pulse contribution and $$E_n=z_n^T z_n \tag{27}$$

is the energy of the filtered noise contribution.

Suppose the code vector $c_p(n)$ in (15) from the pulse subcodebook is a signed vector:

$$c_P=s_P\cdot v_p(i_p) \tag{28}$$

and the code vector $c_n(n)$ in (15) from the noise subcodebook is also a signed vector:

$$c_n=s_n\cdot v_n(i_n), \tag{29}$$

where $v_p(i_p)$ denotes the $i_n$-the pulse vector of dimension 64 (the subframe size), consisting of one or several pulses; $v_n(i_n)$ denotes the $i_n$-th noise vector of dimension 64 (the subframe size), reading from a noise table; $s_p$ and $s_n$ are the signs, equal to −1 or 1, and $i_p$ and $i_n$ are the indices defining the vectors.

The goal of the search procedure is to find the indices $i_p$ and $i_n$ of the two best vectors and their corresponding signs, $s_p$ and $s_n$. This is achieved by maximizing the search criterion (17) where the numerator is calculated by using the equation (19) and the denominator is calculated by using the equation (25). Looking at the numerator (19) and the denominator (25), the most complex computation comes from the middle term of the denominator (25), $z_p^T z_n$, which contains all the possible combinations of the cross correlations. For example, if $c_p$ has $K_p$ possibilities and $c_n$ has $K_n$ possibilities, the middle term, $z_p^T z_n$, may have up to $(K_p \cdot K_n)$ possibilities.

Figure 15A:
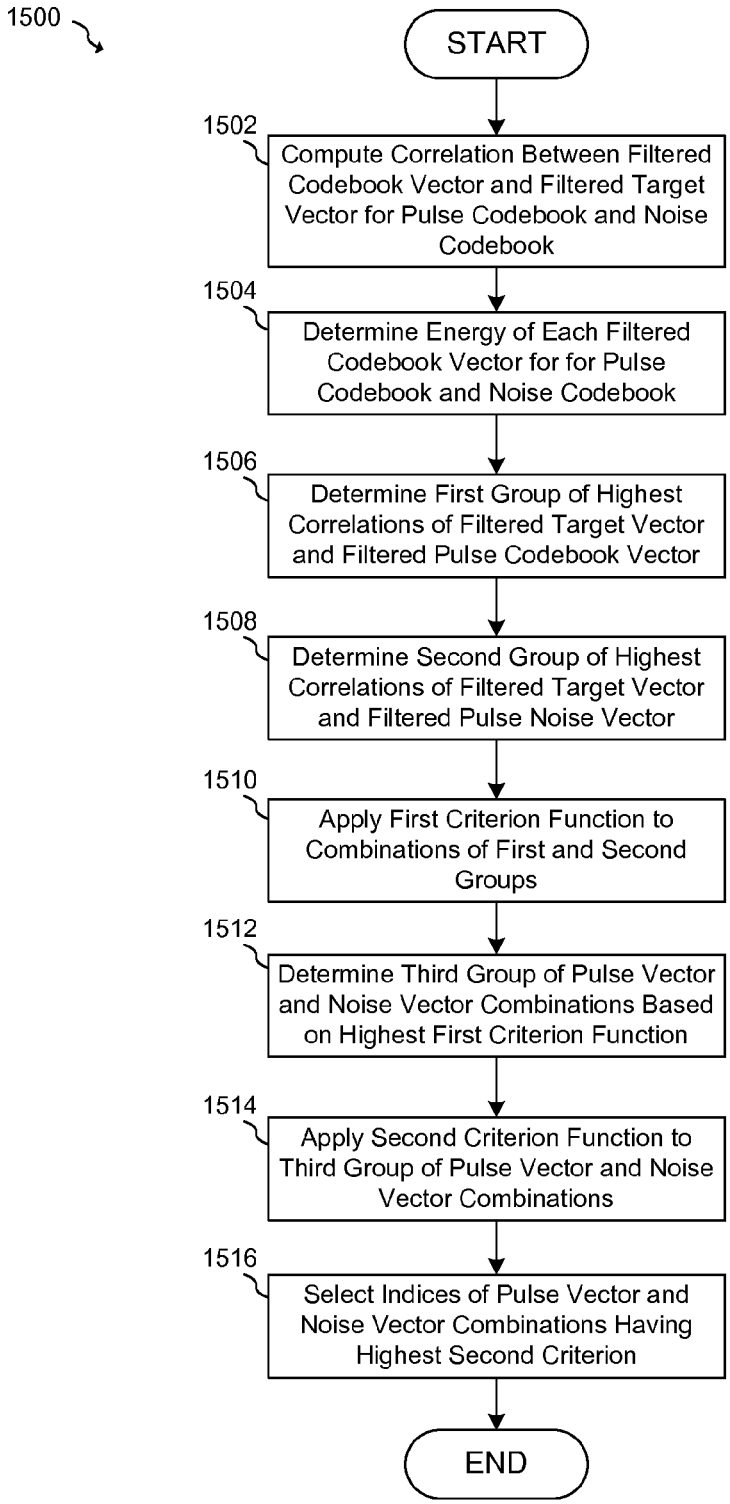
FIGS. 15*a-b* illustrate flowcharts of embodiment methods.

FIG. 15*a* illustrates flowchart 1500 of an embodiment method of a fast mixed codebook search. In step 1502, a correlation is computed between a codebook vector and each filtered target vector for the pulse codebook and for the noise codebook. In one example, after computing the vectors $d_1$ and $d_2$ in (19), a predetermination process is used to identify $K_p^0 \leq K_p$ out of all the $K_p$ possible pulse vectors and $K_n^0 \leq K_n$ out of all the $K_n$ possible noise vectors so that the search process will be confined to those $K_p^0$ possible pulse vectors and $K_n^0$ possible noise vectors.

The pulse predetermination is performed by testing $R_p(i)=d_1^T c_p(i)$ in (19) for the $K_p$ pulse vectors which have the largest absolute dot product (or squared dot product) between $d_1$ and $c_p$. That is the indices of the $K_p^0$ pulse vectors that result in the $K_p^0$ largest values of $|R_p(i)|$ are retained. These indices are stored in the index vector $m_i$, $i=0, \ldots, K_p^0-1$. To further simplify the search, the sign information corresponding to each predetermined vector is also preset. The sign corresponding to each predetermined vector is given by the sign of $R_p(i)$ for that vector. These preset signs are stored in the sign vector $s_p(i)$, $i=0, \ldots, K_p^0-1$. As the candidate vectors $c_p$ contain many zeros, the above predetermination may be computationally simple in some embodiments.

The noise predetermination is performed by testing $R_n(j)=d_2^T c_n(j)$ in (19) for the $K_n$ noise vectors which have the largest absolute dot product (or squared dot product) between $d_2$ and $c_n$. That is the indices of the $K_n^0$ noise vectors that result in the $K_n^0$ largest values of $|R_n(j)|$ are retained. These indices are stored in the index vector $n_j$, $j=0, \ldots, K_n^0-1$. To further simplify the search, the sign information corresponding to each predetermined vector is also preset. The sign corresponding to each predetermined vector is given by the sign of $R_p(j)$ for that vector. These preset signs are stored in the sign vector $s_n(j)$, $j=0, \ldots, K_n^0-1$.

Since the mixed excitation codebook is often used for low bit rates speech coding, $K_p$ or $K_n$ is not large; in this case, the predetermination process simply takes all the $K_p^0=K_p$ possible pulse vectors as candidates and all the $K_n^0=K_n$ possible noise vectors as candidates.

In step 1504, the energy of each filtered codebook vector is determined for the pulse codebook and for the noise codebook. For example, energy term $E_p(i)=z_p^T z_p$ of the filtered pulse vectors in equation (25) is computed for the limited $K_p^0$ possible pulse vectors from Step 1502, and stored with the index vector $m_i$, $i=0, \ldots, K_p^0-1$. In some embodiments, the pulse vectors contain only few non-zero pulses, thereby making the computation of $z_p$ in equation (23) relatively simple. For example, if the pulse vectors contain only one pulse, this computation of the energy term may be simply done by using a recursive way and shifting the pulse position from left to right.

Energy term $E_n(j)=z_n^T z_n$ of the filtered noise vectors in (25) is computed for the limited $K_n^0$ possible noise vectors from Step 1502, and stored with the index vector $n_j$, $j=0, \ldots, K_n^0-1$. If all of the noise vectors are stored in a table in an overlapped manner, the computation of $z_n$ in equation (24) may be done in a recursive way and shifting the noise vector position in the noise table.

Next, in step 1506, a first group of highest correlations of filtered target vectors and filtered pulse codebook vectors are computed, and in step 1508, a second group of highest correlations of filtered target vectors and filtered pulse noise vectors are computed. For example, in one embodiment, K possible combinations of the mixed pulse-noise contributions are from the $(K_p^0 \cdot K_n^0)$ possible combinations that are obtained from step 1502 and step 1504 are computed and chosen. In one embodiment, K is much smaller than $(K_p^0 \cdot K_n^0)$, that is $K<(K_p^0 \cdot K_n^0)$. In some example, four noise vectors and six pulse vectors are chosen to be the K possible combinations, thereby making a total of 24 combinations to be tested. In other examples, other numbers of noise vectors and pulse vectors may be selected. In an embodiment, the number of candidate pulse vectors may exceed the number of candidate noise vectors since calculations on pulse vectors may be more computationally efficient than performing calculations of noise vectors due to the sparse nature of some pulse vectors. (I.e., many of the elements within the pulse vectors may be set to zero.)

Next, a first criterion function is applied to these combinations of the first and second groups in step 1510. In one embodiment, the selection of the K possible combinations may be achieved by maximizing the following simplified criterion of (17), $$Q(i, j) = \frac{[R_p(i) + R_n(j)]^2}{E_p(i) + E_n(j)}; \quad i = 0, 1, \ldots, K_p^0 - 1; \quad j = 0, 1, \ldots, K_n^0 - 1 \tag{30}$$

$$\mathrm{MAX}\{Q(i, j), i = 0, 1, K_p^0 - 1; j = 0, 1, \ldots, K_n^0 - 1\}. \tag{31}$$

In the above expression, $R_p(i)$ and $R_n(j)$ have been computed in step 1502; $E_p(i)$ and $E_n(j)$ have been computed in step 1504.

Next, in step 1512, a first group of pulse vector and noise vector combinations are determined based on the highest first criterion functions. For example, in one embodiment, the indices of the K combinations that result in the K largest values of Q(i, j) are retained. These indices are stored in the index matrix $[i_k, j_k]$, $k=0, 1, \ldots, K-1$. K is much smaller than the number of the total possible combinations of the pulse and noise vectors.

Next, a second criterion function is applied to the third group of pulse vector and noise vector combinations in step 1514, and the indices of the pulse vector and noise vector having the highest second criterion is selected. For example, in one embodiment, once the most promising K combinations of the pulse and noise vectors and their corresponding signs are predetermined in the above Step 1502, 1504, 1506, 1508, 1510, and 1512, the search proceeds with the selection of one pulse vector and one noise vector among those K combinations, which will maximize the full search criterion $Q_k$ of (17):

$$Q_k = \frac{(R_k)^2}{E_k} = \frac{[R_p(i_k) + R_n(j_k)]^2}{E_p(i_k) + 2z_p(i_k)^T z_n(j_k) + E_n(j_k)}, \quad k = 0, 1, \ldots, K - 1. \tag{32}$$

$$\mathrm{MAX}\{Q_k, k = 0, 1, \ldots, K - 1\}. \tag{33}$$

In (32), $R_p(i_k)$, $R_n(j_k)$, $E_p(i_k)$ and $E_n(j_k)$ have been obtained in steps 1502 and 1504, $z_p(i_k)$ and $z_n(j_k)$ have been computed in step 1504. In case that the pulse vectors contain only one pulse, the filtered pulse vector $z_p(i_k)$ in (32) could have zeros from the first element of the vector to the pulse position, which can further simplify the computation.

In some embodiments of the present invention, steps 1510 and 1512 may be omitted in embodiments have a relatively small number of codebook entries. In such an embodiment, the candidate combinations of the first and second groups are applied directly to the second criterion function, for example, equations (32) and (33), and the indices corresponding to the maximum value of the second criterion function are selected.

If there is no limitation that CB 1 contains pulse vectors and CB 2 contains noise vectors, the general mixed codebook can be fast-searched in the following way similar to the above description regarding a codebook using pulse and noise vectors. The impulse response for the CB 1 excitation is, $$h_{CB1}(n)=h_1(n)*h_3(n)*h(n). \tag{34}$$

The impulse response for the CB 2 excitation is, $$h_{CB2}(n)=h_2(n)*h_3(n)*h(n). \tag{35}$$

Let $c_k(n)$ be a mixed code vector which is $$c_k(n)=c_{CB1}(n)*h_1(n)+c_{CB2}(n)*h_2(n), n=0,1, \ldots ,63. \tag{36}$$

The mixed codebook excitation $c_k(n)$ or $e_c(n)=c_k(n)*h_3(n)$ and the corresponding gain 1406 $G_c$ may be determined through the minimization of the criterion:

$$Q_k = \frac{(R_k)^2}{E_k} = \frac{[d_1^T c_{CB1} + d_2^T c_{CB2}]^2}{E_{CB1} + 2z_{CB1}^T z_{CB2} + E_{CB2}} \tag{37}$$

where $$z_{CB1} = H_{CB1} c_{CB1} \tag{38}$$

$$z_{CB2} = H_{CB2} c_{CB2} \tag{39}$$

$$E_{CB1} = z_{CB1}^T z_{CB1} \tag{40}$$

$$E_{CB2} = z_{CB2}^T z_{CB2}. \tag{41}$$

Suppose the code vectors $c_{CB1}$ and $c_{CB2}$ are signed vectors:

$$c_{CB1}=s_{CB1} \cdot v_{CB1}(i_{CB1}) \tag{42}$$

$$c_{CB2}=s_{CB2} \cdot v_{CB2}(i_{CB2}). \tag{43}$$

The goal of the search procedure is to find the indices $i_{CB1}$ and $i_{CB2}$ of the two best vectors and their corresponding signs, $s_{CB1}$ and $s_{CB2}$.

Figure 15B:
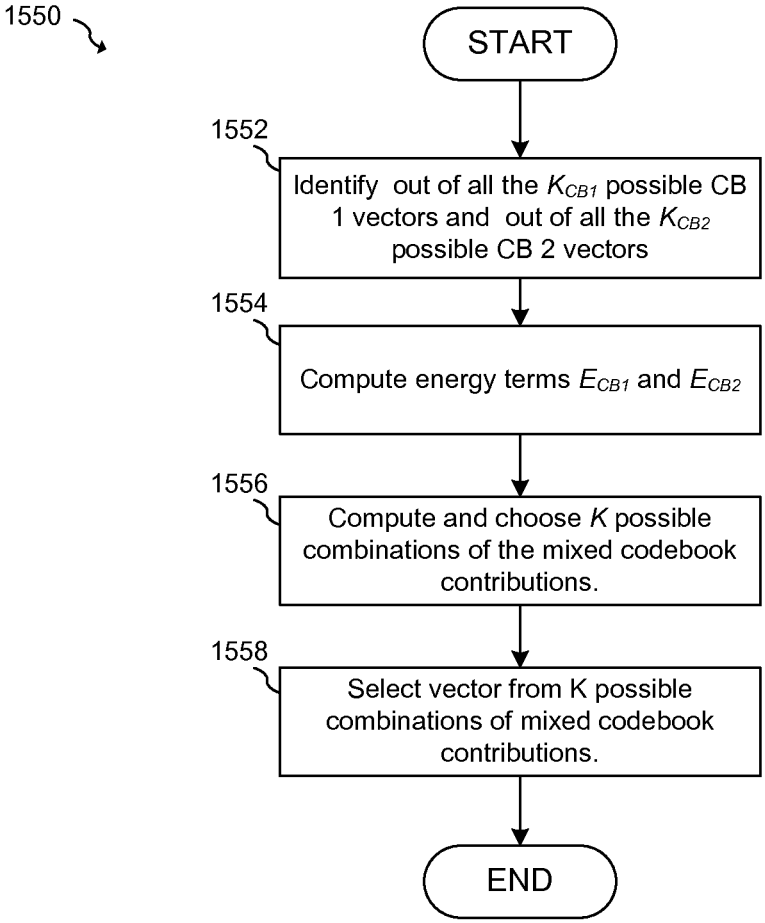

FIG. 15*b* illustrates embodiment method 1550 for performing a fast search of a general mixed codebook. It should be appreciated that method 1500 of FIG. 15*a* described above may be considered a special case of method 1550 in some embodiments.

In an embodiment, in step 1552, after computing the vectors $d_1$ and $d_2$ in (37), a predetermination process is used to identify $K_{CB1}^0 \leq K_{CB1}$ out of all the $K_{CB1}$ possible CB 1 vectors and $K_{CB2}^0 \leq K_{CB2}$ out of all the $K_{CB2}$ possible CB 2 vectors. The CB 1 predetermination is performed by testing $R_{CB1}(i)=d_1^T c_{CB1}(i)$ in equation (37) for the $K_{CB1}$ CB 1 vectors which have the largest absolute dot product (or squared dot product) between $d_1$ and $c_{CB1}$. That is, the indices of the $K_{CB1}^0$ CB 1 vectors that result in the $K_{CB1}^0$ largest values of $|R_{CB1}(i)|$ are retained. These indices are stored in the index vector $m_i$, $i=0, \ldots, K_{CB1}^0-1$. To further simplify the search, the sign information corresponding to each predetermined vector is also preset. The sign corresponding to each predetermined vector is given by the sign of $R_{CB1}(i)$ for that vector. These preset signs are stored in the sign vector $s_{CB1}(i)$, $i=0, \ldots, K_{CB1}^0-1$.

In an embodiment, the CB 2 predetermination is performed by testing $R_{CB2}(j)=d_2^T c_{CB2}(j)$ in equation (37) for the $K_{CB2}$ CB 2 vectors which have the largest absolute dot product (or squared dot product) between $d_2$ and $c_{CB2}$. That is, the indices of the $K_{CB2}^0$ CB 2 vectors that result in the $K_{CB2}^0$ largest values of $|R_{CB2}(j)|$ are retained. These indices are stored in the index vector $n_j$, $j=0, \ldots, K_{CB2}^0-1$. To further simplify the search, the sign information corresponding to each predetermined vector is also preset. The sign corresponding to each predetermined vector is given by the sign of $R_{CB2}(j)$ for that vector. These preset signs are stored in the sign vector $s_{CB2}(j)$, $j=0, \ldots, K_{CB2}^0-1$.

As the mixed excitation codebook is often used for low bit rates speech coding, $K_{CB1}$ or $K_{CB2}$ is not large. In this case, the predetermination process simply takes all the $K_{CB1}^0=K_{CB1}$ possible CB 1 vectors as candidates and all the $K_{CB2}^0=K_{CB2}$ possible CB 2 vectors as candidates.

Next, in step 1554, energy terms $E_{CB1}$ and $E_{CB2}$ are computed. In an embodiment, term $E_{CB1}(i)=z_{CB1}^T z_{CB1}$ of the filtered CB 1 vectors in equation (40) is computed for the limited $K_{CB1}^0$ possible CB 1 vectors from Step 1552, stored with the index vector $m_i$, $i=0, \ldots, K_{CB1}^0-1$.

Energy term $E_{CB2}(j)=z_{CB2}^T z_{CB2}$ of the filtered CB 2 vectors in equation (41) is also computed for the limited $K_{CB2}^0$ possible CB 2 vectors from Step 1552, stored with the index vector, $n_j$, $j=0, \ldots, K_{CB2}^0-1$. In some embodiments, energy terms $E_{CB1}$ and $E_{CB2}$ may be pre-computed and stored in memory.

In step 1556, Compute and choose K possible combinations of the mixed codebook contributions from the $(K_{CB1}^0 \cdot K_{CB2}^0)$ possible combinations obtained by step 1552 and step 1554 are computed and chosen. In some embodiments, K is smaller than $(K_{CB1}^0 \cdot K_{CB2}^0)$, that is $K<(K_{CB1}^0 \cdot K_{CB2}^0)$. The selection of the K possible combinations is achieved by maximizing the following simplified criterion of (37), $$Q(i, j) = \frac{[R_{CB1}(i) + R_{CB2}(j)]^2}{E_{CB1}(i) + E_{CB2}(j)}; \quad i = 0, 1, \ldots, K_{CB1}^0 - 1; \quad j = 0, 1, \ldots, K_{CB2}^0 - 1 \tag{44}$$

$$\mathrm{MAX}\{Q(i, j), i = 0, 1, \ldots, K_{CB1}^0 - 1; j = 0, 1, \ldots, K_{CB2}^0 - 1\} \tag{45}$$

In the above expression, $R_{CB1}(i)$ and $R_{CB2}(j)$ have been computed in Step 1552, and $E_{CB1}(i)$ and $E_{CB2}(j)$ have been computed in Step 1554. The indices of the K combinations that result in the K largest values of Q(i, j) are retained. These indices are stored in the index matrix $[i_k, j_k]$, $k=0, 1, \ldots, K-1$. K is much smaller than the number of the total possible combinations of the mixed codebook vectors.

Next in step 1558, a vector is selected from the K possible combinations determined in step 1556. For example, once the most promising K combinations of the mixed codebook vectors and their corresponding signs are predetermined in the above Step 1552, Step 1554 and Step 1556, the search proceeds with the selection of one CB 1 vector and one CB 2 vector among those K combinations, which will maximize the full search criterion $Q_k$ of (37):

$$Q_k = \frac{[R_{CB1}(i_k) + R_{CB2}(j_k)]^2}{E_{CB1}(i_k) + 2z_{CB1}(i_k)^T z_{CB2}(j_k) + E_{CB2}(j_k)}, \quad k = 0, 1, \ldots, K - 1. \tag{46}$$

$$\mathrm{MAX}\{Q_k, k = 0, 1, \ldots, K - 1\}. \tag{47}$$

In (46), $R_{CB1}(i_k)$, $R_{CB2}(j_k)$, $E_{CB1}(i_k)$ and $E_{CB2}(j_k)$ have been obtained in Step 1556; $z_{CB1}(i_k)$ and $z_{CB2}(j_k)$ have been computed in Step 1554.

In some embodiments of the present invention, the computation of equations (44) and (45) may be omitted and equations (46) and (47) may be used to determine the selected mixed codebook vector directly for embodiments having a relatively small size codebook.

Steps 1510 and 1512 may be omitted in embodiments having a relatively small number of codebook entries. In such an embodiment, the candidate combinations of the first and second groups are applied directly to the second criterion function, for example, equations (32) and (33), and the indices corresponding to the maximum value of the second criterion function are selected and evaluated as follows:

$$Q(i, j) = \frac{[R_{CB1}(i) + R_{CB2}(j)]^2}{E_{CB1}(i) + 2z_{CB1}(i)^T z_{CB2}(j) + E_{CB2}(j)} \quad (48)$$

$$i = 0, 1, \ldots, K^0_{CB1} - 1;\ j = 0, 1, \ldots, K^0_{CB2} - 1$$

$$\mathrm{MAX}\{Q(i, j), i = 0, 1, \ldots, K^0_{CB1} - 1;\ j = 0, 1, \ldots, K^0_{CB2} - 1\} \quad (49)$$

Equations (48) and (49) may also be applied to method 1500 discussed above in some embodiments.

Signal to Noise Ratio (SNR) is one of the objective test measuring methods for speech coding. Weighted Segmental SNR (WsegSNR) is another objective measuring. WsegSNR might be slightly closer to real perceptual quality measuring than SNR. Small difference in SNR or WsegSNR may not be audible. Large difference in SNR or WsegSNR may obviously be audible. For clean speech signal, the obtained SNR or WsegSNR with the pulse-noise mixed FCB may be equivalent to the ones obtained by using a pulse-like FCB with the same FCB size. For noisy speech signal, the obtained SNR or WsegSNR with the pulse-noise mixed FCB may be slightly higher than the ones obtained by using a pulse-like FCB with the same FCB size. Furthermore, for all kind of speech signals, the obtained SNR or WsegSNR with the fast mixed FCB search is very close to the ones with the full mixed FCB search.

In some embodiments, listening test results indicate that the perceptual quality of noisy speech signal is clearly improved by using the pulse-noise mixed FCB instead of a pulse-like FCB, which sounds smoother, more natural and less spiky. In addition, test results show that the perceptual quality with the fast mixed FCB search is equivalent to the one with the full mixed FCB search.

Figure 16:
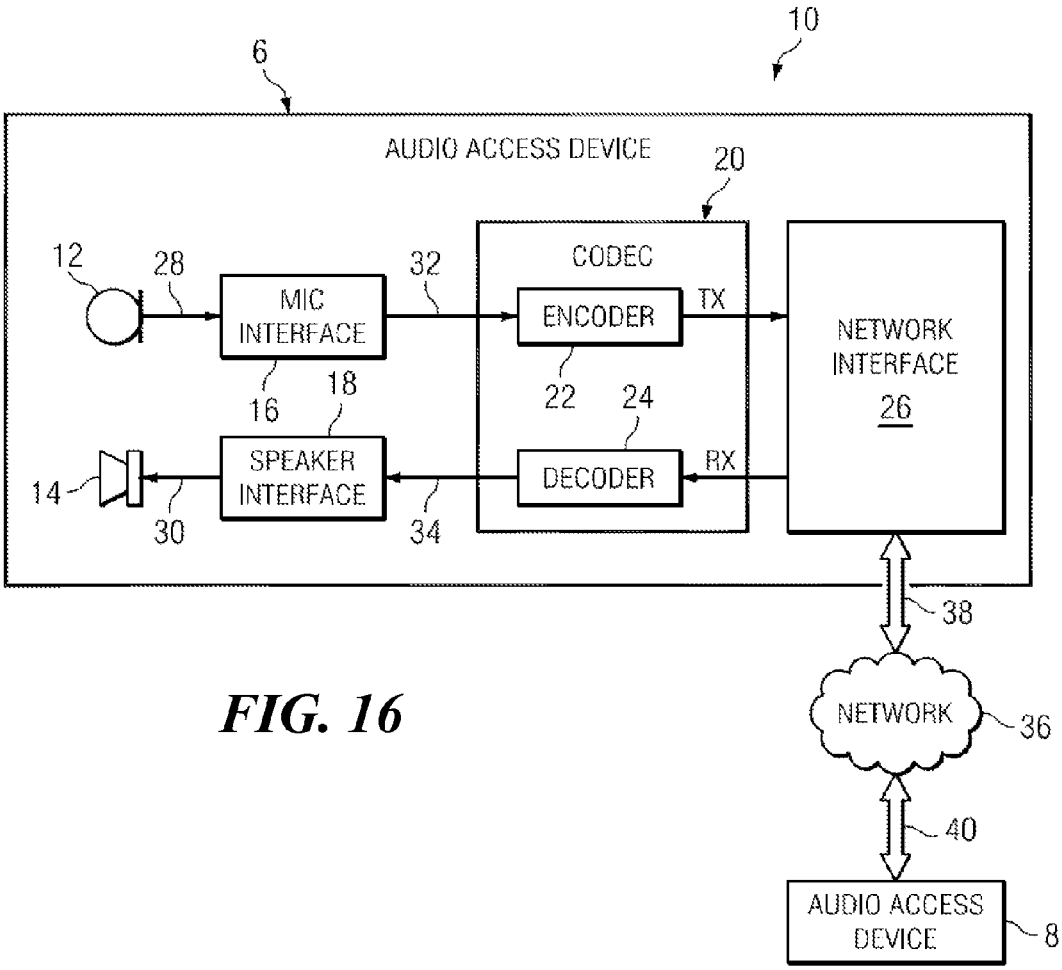
FIG. 16 illustrates an embodiment communication system.

FIG. 16 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PTSN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In embodiments of the present invention, where audio access device 6 is a VOIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

In accordance with an embodiment, a method of encoding an audio/speech signal includes determining a mixed codebook vector based on an incoming audio/speech signal, the mixed codebook vector comprising a sum of a first codebook entry from a first codebook and a second codebook entry from a second codebook. The method further includes generating an encoded audio signal based on the determined mixed codebook vector, and transmitting a coded excitation index of the determined mixed codebook vector. In an embodiment, the first codebook includes pulse-like entries and the second codebook includes noise-like entries. In some embodiments, the first and second codebooks include fixed codebooks. The steps of determining and generating may be performed using a hardware-based audio encoder. The hardware-based audio encoder may include a processor and/or dedicated hardware.

In an embodiment, determining the mixed codebook vector includes computing first correlations between a filtered target vector and filtered entries in the first codebook, determining a first group of highest first correlations, computing correlations between a filtered target vector and filtered entries in the second codebook, determining a second group of highest second correlations, and computing a first criterion function of combinations of the first and second groups. The first criterion function includes a function of one of the first group of highest first correlations, one of the second group of highest second correlations and an energy of corresponding entries from the first codebook and the second codebook. The filtered target vector is based on the incoming audio signal.

In an embodiment the method further includes determining a third group of candidate correlations based on highest computed first criterion functions, and selecting the mixed codebook vector based on applying a second criterion function to the third group. The mixed codebook vector corresponds to codebook entries from the first codebook and the second codebook associated with a highest value of the second criterion function.

In an embodiment, the first criterion function is $$Q(i, j) = \frac{[R_{CB1}(i) + R_{CB2}(j)]^2}{E_{CB1}(i) + E_{CB2}(j)};$$
$$i = 0, 1, \ldots, K_{CB1}^0 - 1;$$
$$j = 0, 1, \ldots, K_{CB2}^0 - 1,$$

where $R_{CB1}(i)$ is a correlation between the filtered target vector and an $i^{th}$ first entry of the first codebook, $R_{CB2}(j)$ is a correlation between the filtered target vector and a $j^{th}$ entry of the second codebook, $E_{CB1}(i)$ is an energy of the $i^{th}$ entry of the first codebook and $E_{CB2}(i)$ is an energy of the $j^{th}$ entry of the second codebook, $K_{CB1}{}^0$ is a number of first codebook entries in the first group and $K_{CB2}{}^0$ is a number of second codebook entries in the second group. The second criterion may be expressed as $$Q_k = \frac{[R_{CB1}(i_k) + R_{CB2}(j_k)]^2}{E_{CB1}(i_k) + 2z_{CB1}(i_k)^T z_{CB2}(j_k) + E_{CB2}(j_k)},$$
$$k = 0, 1, \ldots, K - 1,$$

where $z_{CB1}(i_k)$ is a filtered vector of the $i^{th}$ entry of the first codebook and $z_{CB2}(j_k)$ is a filtered vector of the $j^{th}$ entry of the second codebook, and K is a number of entries in the third group.

In some embodiments, the method includes selecting the mixed codebook vector based on a highest computed first criterion function. This highest computed first criterion function may be $$Q(i, j) = \frac{[R_{CB1}(i) + R_{CB2}(j)]^2}{E_{CB1}(i) + E_{CB2}(j)};$$
$$i = 0, 1, \ldots, K_{CB1}^0 - 1;\ j = 0, 1, \ldots, K_{CB2}^0 - 1$$

where $R_{CB1}(i)$ is a correlation between the filtered target vector and an $i^{th}$ first entry of the first codebook, $R_{CB2}(j)$ is a correlation between the filtered target vector and a $j^{th}$ entry of the second codebook, $E_{CB1}(i)$ is an energy of the $i^{th}$ entry of the first codebook and $E_{CB2}(i)$ is an energy of the $j^{th}$ entry of the second codebook, and $K_{CB1}{}^0$ is a number of first codebook entries in the first group and $K_{CB2}{}^0$ is a number of second codebook entries in the second group.

In an embodiment, the method further includes comprising calculating energies of the corresponding entries from the first codebook and the second codebook. In some cases, the energy of corresponding entries from the first codebook and the second codebook are stored in memory. Furthermore, first group may include more entries than the second group.

In an embodiment, the method further includes applying a first emphasis function to the first codebook entry, and applying a second emphasis function to the second codebook entry. The first emphasis function may include a low pass filtering function, and the second emphasis function may include a high pass filtering function.

In accordance with a further embodiment, a system for encoding an audio/speech signal that includes a hardware-based audio coder configured to determine a mixed codebook vector based on an incoming audio/speech signal, generate an encoded audio/speech signal based on the determined mixed codebook vector, transmit a coded excitation index of the determined mixed codebook vector. The mixed codebook vector includes a sum of a first codebook entry from a pulse-like codebook and a second codebook entry from a noise-like codebook. The hardware-based audio encoder may include a processor and/or dedicated hardware.

In an embodiment, the hardware-based audio coder is further configured to compute first correlations between a filtered target vector and entries in the pulse-like codebook, determine a first group of highest first correlations, compute correlations between a filtered target vector and entries in the noise-like codebook, determine a second group of highest second correlations, and compute a first criterion function of combinations of first and second groups. The first criterion function includes a function of one of the first group of highest first correlations, one of the second group of highest second correlations and an energy of corresponding entries from the pulse-like codebook and the noise-like codebook. Furthermore, the filtered target vector is based on the incoming audio signal. In some embodiments, the system further includes a memory configured to store values of the energy of corresponding entries from the pulse-like codebook and the noise-like codebook.

In an embodiment, the hardware-based audio coder may be further configured to select the mixed codebook vector based on a highest computed first criterion function. This first criterion function may be expressed as $$Q(i, j) = \frac{[R_{CB1}(i) + R_{CB2}(j)]^2}{E_{CB1}(i) + E_{CB2}(j)};$$
$$i = 0, 1, \ldots, K_{CB1}^0 - 1;$$
$$j = 0, 1, \ldots, K_{CB2}^0 - 1$$

where $R_{CB1}(i)$ is a correlation between the filtered target vector and an $i^{th}$ first entry of the first codebook, $R_{CB2}(j)$ is a correlation between the filtered target vector and a $j^{th}$ entry of the second codebook, $E_{CB1}(i)$ is an energy of the $i^{th}$ entry of the first codebook and $E_{CB2}(i)$ is an energy of the $j^{th}$ entry of the second codebook, and $K_{CB1}{}^0$ is a number of first codebook entries in the first group and $K_{CB2}{}^0$ is a number of second codebook entries in the second group.

In accordance with a further embodiment, a fast search method of a mixed codebook for encoding an audio/speech signal includes determining a mixed codebook vector based on an incoming audio/speech signal, where the mixed codebook vector includes a sum of a first codebook entry from a first codebook and a second codebook entry from a second codebook. The method further includes computing first correlations between a filtered target vector and filtered entries in the first codebook determining a first group of highest first correlations, computing correlations between a filtered target vector and filtered entries in the second codebook, determining a second group of highest second correlations, and computing a first criterion function of combinations of the first and second groups. The first criterion function includes a function of one of the first group of highest first correlations, one of the second group of highest second correlations and an energy of corresponding entries from the first codebook and the second codebook, and the filtered target vector is based on the incoming audio signal. The method further includes determining a third group of candidate correlations based on highest computed first criterion functions, selecting the mixed codebook vector based on applying a second criterion function to the third group, wherein the mixed codebook vector corresponds to codebook entries from the first codebook and the second codebook associated with a highest value of the second criterion function. In addition, the method further includes generating an encoded audio signal based on the determined mixed codebook vector, and transmitting a coded excitation index of the determined mixed codebook vector, wherein the determining and generating are performed using a hardware-based audio encoder. The hardware-based audio encoder may include a processor and/or dedicated hardware.

In an embodiment, the first criterion function is $$Q(i, j) = \frac{[R_{CB1}(i)R_{CB2}(j)]^2}{E_{CB1}(i) + E_{CB2}(j)};$$
$$i = 0, 1, \ldots, K_{CB1}^0 - 1;$$
$$j = 0, 1, \ldots, K_{CB2}^0 - 1,$$

where $R_{CB1}(i)$ is a correlation between the filtered target vector and an $i^{th}$ first entry of the first codebook, $R_{CB2}(j)$ is a correlation between the filtered target vector and a $j^{th}$ entry of the second codebook, $E_{CB1}(i)$ is an energy of the $i^{th}$ entry of the first codebook and $E_{CB2}(i)$ is an energy of the $j^{th}$ entry of the second codebook, $K_{CB1}{}^0$ is a number of first codebook entries in the first group and $K_{CB2}{}^0$ is a number of second codebook entries in the second group. The second criterion function is $$Q_k = \frac{[R_{CB1}(i_k) + R_{CB2}(j_k)]^2}{E_{CB1}(i_k) + 2z_{CB1}(i_k)^T z_{CB2}(j_k) + E_{CB2}(j_k)},$$
$$k = 0, 1, \ldots, K - 1,$$

where $z_{CB1}(i_k)$ is a filtered vector of the $i^{th}$ entry of the first codebook and $z_{CB2}(j_k)$ is a filtered vector of the $j^{th}$ entry of the second codebook, and K is a number of entries in the third group. In some embodiments, the first codebook may be a pulse-like codebook and the second codebook may be a noise-like codebook.

An advantage of embodiment systems that use mixed pulse-noise excitation include the ability to produce a better perceptual quality of GENERIC speech signal than using pulse only excitation or noise only excitation. Furthermore, in some embodiments, a fast search approach of the pulse-noise excitation results in a low complexity system, thereby making the pulse-noise excitation algorithm more attractive.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of encoding an audio/speech signal, the method comprising:

for each frame in an incoming audio/speech signal having a low bit rate, determining a mixed excitation and an adaptive codebook excitation based on the incoming audio/speech signal, the mixed excitation comprising a sum of a first excitation entry from a first codebook and a second excitation entry from a second codebook, wherein the first and second codebooks are both fixed but different codebooks, wherein the adaptive excitation comprises an entry from an adaptive codebook, wherein the first codebook comprises pulse-like entries, wherein the pulse-like entries comprise non-periodic, signed, and unit magnitude pulses specially designed for an Algebraic Code-Excited Linear Prediction (ACELP) speech coding algorithm, and the second codebook comprises noise-like entries, wherein determining the mixed excitation is performed in time domain;

applying a first filter to the first excitation entry from the first codebook;

applying a second filter to the second excitation entry from the second codebook, the second filter being different from the first filter;

for each subframe in each frame in the incoming audio/speech signal, searching pulse-like entries in the first codebook, by using an Analysis-By-Synthesis searching approach, to find an entry that minimizes a weighted error between a synthesized speech and the incoming audio/speech signal, and coding an index of the entry to obtain at least one coded excitation index;

generating an encoded audio signal based on the determined mixed excitation and the adaptive codebook excitation; and transmitting the at least one coded excitation index of the determined mixed excitation, wherein the determining and generating are performed using a hardware-based audio encoder.

2. The method of claim 1, wherein determining the mixed excitation comprises:

computing first correlations between a filtered target vector and filtered entries in the first codebook, wherein the filtered target vector is based on the incoming audio signal;

determining a first group of highest first correlations;

computing second correlations between a filtered target vector and filtered entries in the second codebook;

determining a second group of highest second correlations; and computing a first criterion function of combinations of the first and second groups, wherein the first criterion function comprises a function of one of the first group of highest first correlations, one of the second group of highest second correlations and an energy of corresponding entries from the first codebook and the second codebook.

3. The method of claim 2, further comprising:

determining a third group of candidate correlations based on a highest computed first criterion functions; and selecting the mixed excitation based on applying a second criterion function to the third group, wherein the mixed excitation corresponds to codebook entries from the first codebook and the second codebook associated with a highest value of the second criterion function.

4. The method of claim 3, wherein:

the first criterion function is $$Q(i, j) = \frac{[R_{CB1}(i) + R_{CB2}(j)]^2}{E_{CB1}(i) + E_{CB2}(j)}; i = 0, 1, \ldots, K^0_{CB1} - 1;$$
$$j = 0, 1, \ldots, K^0_{CB2} - 1,$$

where $R_{CB1}(i)$ is a correlation between the filtered target vector and an $i^{th}$ first entry of the first codebook, $R_{CB2}(j)$ is a correlation between the filtered target vector and a $j^{th}$ entry of the second codebook, $E_{CB1}(i)$ is an energy of the $i^{th}$ entry of the first codebook and $E_{CB2}(i)$ is an energy of the $j^{th}$ entry of the second codebook, $K_{CB1}{}^0$ is a number of first codebook entries in the first group and $K_{CB2}{}^0$ is a number of second codebook entries in the second group; and the second criterion function is $$Q_k = \frac{[R_{CB1}(i_k) + R_{CB2}(j_k)]^2}{E_{CB1}(i_k) + 2z_{CB1}(i_k)^T z_{CB2}(j_k) + E_{CB2}(j_k)},$$
$$k = 0, 1, \ldots, K - 1,$$

where $z_{CB1}(i_k)$ is a filtered vector of the $i^{th}$ entry of the first codebook and $z_{CB2}(j_k)$ is a filtered vector of the $j^{th}$ entry of the second codebook, and K is a number of entries in the third group.

5. The method of claim 2, wherein selecting the mixed excitation based on a highest computed first criterion function.

6. The method of claim 5, wherein the first criterion function is $$Q(i, j) = \frac{[R_{CB1}(i) + R_{CB2}(j)]^2}{E_{CB1}(i) + E_{CB2}(j)}; i = 0, 1, \ldots, K^0_{CB1} - 1;$$
$$j = 0, 1, \ldots, K^0_{CB2} - 1$$

where $R_{CB1}(i)$ is a correlation between the filtered target vector and an $i^{th}$ first entry of the first codebook, $R_{CB2}(j)$ is a correlation between the filtered target vector and a $j^{th}$ entry of the second codebook, $E_{CB2}(i)$ is an energy of the $i^{th}$ entry of the first codebook and $E_{CB2}(i)$ is an energy of the $j^{th}$ entry of the second codebook, and $K_{CB1}{}^0$ is a number of first codebook entries in the first group and $K_{CB2}{}^0$ is a number of second codebook entries in the second group.

7. The method of claim 2, further comprising calculating energies of the corresponding entries from the first codebook and the second codebook.

8. The method of claim 2, wherein the energy of corresponding entries from the first codebook and the second codebook are stored in memory.

9. The method of claim 2, wherein the first group comprises more entries than the second group.

10. The method of claim 1, wherein the first filter applies a first emphasis function to the first excitation entry, and wherein the second filter applies a second emphasis function to the second excitation entry.

11. The method of claim 10, wherein:

the first filter comprises a low pass filtering function; and the second filter comprises a high pass filtering function.

12. The method of claim 1, wherein the hardware-based audio encoder comprises a processor.

13. The method of claim 1, wherein the hardware-based audio encoder comprises dedicated hardware.

14. A system for encoding an audio/speech signal, the system comprising:

a hardware-based audio coder configured to:

for each frame in an incoming audio/speech signal having a low bit rate, determine a mixed excitation and an adaptive codebook excitation based on the incoming audio/speech signal, the mixed excitation comprising a sum of a first excitation entry from a pulse-like codebook and a second excitation entry from a noise-like codebook, wherein the pulse-like codebook and the noise-like codebook are both fixed but different codebooks, wherein the adaptive excitation comprises an entry from an adaptive codebook, wherein the pulse-like codebook comprises non-periodic, signed, and unit magnitude pulses specially designed for an Algebraic Code-Excited Linear Prediction (ACELP) speech coding algorithm, wherein the mixed excitation is configured to be determined in time domain;

apply a first filter to the first excitation entry from the pulse-like codebook;

apply a second filter to the second excitation entry from the noise-like codebook, the second filter being different from the first filter;

for each subframe in each frame in the incoming audio/speech signal, search pulse-like entries in the pulse-like codebook, by using an Analysis-By-Synthesis searching approach, to find an entry that minimizes a weighted error between a synthesized speech and the incoming audio/speech signal, and coding an index of the entry to obtain at least one coded excitation index;

generate an encoded audio/speech signal based on the determined mixed excitation and the adaptive codebook excitation; and transmit the at least one coded excitation index of the determined mixed excitation, wherein the hardware-based audio coder is a code excited linear prediction technique coder.

15. The system of claim 14, wherein the hardware-based audio coder is further configured to:

compute first correlations between a filtered target vector and entries in the pulse-like codebook, wherein the filtered target vector is based on the incoming audio signal;

determine a first group of highest first correlations;

compute correlations between a filtered target vector and entries in the noise-like codebook;

determine a second group of highest second correlations; and compute a first criterion function of combinations of first and second groups, wherein the first criterion function comprises a function of one of the first group of highest first correlations, one of the second group of highest second correlations and an energy of corresponding entries from the pulse-like codebook and the noise-like codebook.

16. The system of claim 15, further comprising a memory configured to store values of the energy of corresponding entries from the pulse-like codebook and the noise-like codebook.

17. The system of claim 15, wherein the hardware-based audio coder is further configured to select the mixed excitation based on a highest computed first criterion function.

18. The system of claim 15, wherein the first criterion function is $$Q(i, j) = \frac{[R_{CB1}(i) + R_{CB2}(j)]^2}{E_{CB1}(i) + E_{CB2}(j)};$$
$$i = 0, 1, \ldots, K^0_{CB1} - 1;$$
$$j = 0, 1, \ldots, K^0_{CB2} - 1$$

where $R_{CB1}(i)$ is a correlation between the filtered target vector and an $i^{th}$ first entry of the pulse-like codebook, $R_{CB2}(j)$ is a correlation between the filtered target vector and a $j^{th}$ entry of the noise-like codebook, $E_{CB1}(i)$ is an energy of the $i^{th}$ entry of the pulse-like codebook and $E_{CB2}(i)$ is an energy of the $j^{th}$ entry of the noise-like codebook, and $K_{CB1}{}^0$ is a number of first codebook entries in the first group and $K_{CB2}{}^0$ is a number of second codebook entries in the second group.

19. The system of claim 14, wherein the hardware-based audio coder comprises a processor.

20. The system of claim 14, wherein the hardware-based audio coder comprises dedicated hardware.

21. A fast search method of a mixed codebook for encoding an audio/speech signal, the method comprising:

determining a mixed excitation based on an incoming audio/speech signal, the mixed excitation comprising a sum of a first excitation entry from a first codebook and a second excitation entry from a second codebook, wherein the first codebook comprises pulse-like entries, wherein the pulse-like entries comprise pulses specially designed for an Algebraic Code-Excited Linear Prediction (ACELP) speech coding algorithm, and the second codebook comprises noise-like entries, wherein determining the mixed excitation is performed in time domain;

computing first correlations between a filtered target vector and filtered entries in the first codebook, wherein the filtered target vector is based on the incoming audio signal;

determining a first group of highest first correlations;

computing correlations between a filtered target vector and filtered entries in the second codebook;

determining a second group of highest second correlations;

computing a first criterion function of combinations of the first and second groups, wherein the first criterion function comprises a function of one of the first group of highest first correlations, one of the second group of highest second correlations and an energy of corresponding entries from the first codebook and the second codebook;

determining a third group of candidate correlations based on highest computed first criterion functions;

selecting the mixed excitation based on applying a second criterion function to the third group, wherein the mixed excitation corresponds to codebook entries from the first codebook and the second codebook associated with a highest value of the second criterion function;

coding an index of the entry from the first codebook of the selected mixed excitation to obtain at least one coded excitation index;

generating an encoded audio signal based on the determined mixed excitation; and transmitting the at least one coded excitation index of the determined mixed excitation, wherein the determining and generating are performed using a hardware-based audio encoder.

22. The method of claim 21, wherein:

the first criterion function is $$Q(i, j) = \frac{[R_{CB1}(i) + R_{CB2}(j)]^2}{E_{CB1}(i) + E_{CB2}(j)};$$
$$i = 0, 1, \ldots, K^0_{CB1} - 1;$$
$$j = 0, 1, \ldots, K^0_{CB2} - 1,$$

where $R_{CB1}(i)$ is a correlation between the filtered target vector and an $i^{th}$ first entry of the first codebook, $R_{CB2}(j)$ is a correlation between the filtered target vector and a $j^{th}$ entry of the second codebook, $E_{CB1}(i)$ is an energy of the $i^{th}$ entry of the first codebook and $E_{CB2}(i)$ is an energy of the $j^{th}$ entry of the second codebook, $K_{CB1}{}^0$ is a number of first codebook entries in the first group and $K_{CB2}{}^0$ is a number of second codebook entries in the second group; and the second criterion function is $$Q_k = \frac{[R_{CB1}(i_k) + R_{CB2}(j_k)]^2}{E_{CB1}(i_k) + 2z_{CB1}(i_k)^T z_{CB2}(j_k) + E_{CB2}(j_k)},$$
$$k = 0, 1, \ldots, K - 1,$$

where $z_{CB1}(i_k)$ is a filtered vector of the $i^{th}$ entry of the first codebook and $z_{CB2}(j_k)$ is a filtered vector of the $j^{th}$ entry of the second codebook, and K is a number of entries in the third group.

23. The method of claim 21, wherein the first codebook comprises a pulse-like codebook and the second codebook comprises a noise-like codebook.

* * * * *